US011484806B2

(12) United States Patent
Del Giudice et al.

(10) Patent No.: US 11,484,806 B2
(45) Date of Patent: Nov. 1, 2022

(54) BUOYANCY ASSISTED TOY PACKAGING

(71) Applicant: MOOSE CREATIVE MANAGEMENT PTY LIMITED, Cheltenham (AU)

(72) Inventors: Dean Del Giudice, Melbourne (AU); Miguel Rusch, Melbourne (AU); Nicholas St Clair Max Heine, St Kilda West (AU)

(73) Assignee: MOOSE CREATIVE MANAGEMENT PTY LIMITED, Cheltenham (AU)

( * ) Notice: Subject to any disclaimer, the term of this patent is extended or adjusted under 35 U.S.C. 154(b) by 10 days.

(21) Appl. No.: 16/994,406

(22) Filed: Aug. 14, 2020

(65) Prior Publication Data

US 2022/0047957 A1 Feb. 17, 2022

(51) Int. Cl.
*A63H 23/10* (2006.01)

(52) U.S. Cl.
CPC ..... *A63H 23/10* (2013.01); *A63F 2250/0407* (2013.01)

(58) Field of Classification Search
CPC ..... A63H 23/10; A63H 23/12; A63H 13/16; A63F 2250/0407
USPC ... 446/73, 74, 153, 155, 156, 157, 158, 159, 446/161, 308, 309, 310, 475, 486, 487
See application file for complete search history.

(56) References Cited

U.S. PATENT DOCUMENTS

| | | | | | |
|---|---|---|---|---|---|
| 1,622,570 | A | * | 3/1927 | Budde | A63H 23/08 446/155 |
| 2,580,414 | A | * | 1/1952 | Duffey | A61J 3/07 424/408 |
| 3,621,604 | A | * | 11/1971 | Danielsen et al. | A63H 23/08 446/155 |
| 3,632,039 | A | | 1/1972 | Gayle | |
| 3,680,250 | A | | 8/1972 | Hetrick | |
| 3,713,250 | A | * | 1/1973 | Clough, Jr. | A63H 23/00 446/155 |
| 4,065,870 | A | * | 1/1978 | Muko | A01K 97/04 43/44.99 |
| 4,122,627 | A | * | 10/1978 | Kubiatowicz | A63H 23/10 446/156 |
| 4,198,780 | A | * | 4/1980 | Kubiatowicz | A63H 23/10 446/156 |

(Continued)

FOREIGN PATENT DOCUMENTS

| | | | |
|---|---|---|---|
| EP | 2518121 | A1 | 10/2012 |
| WO | WO 2003/016165 | A1 | 2/2003 |
| WO | WO 2008/135751 | A2 | 11/2008 |

*Primary Examiner* — Joseph B Baldori
(74) *Attorney, Agent, or Firm* — Knobbe Martens Olson & Bear, LLP

(57) ABSTRACT

A toy package is partially submerged in liquid to cause the toy package to move from a closed configuration to an open configuration. The toy package includes a first portion supported by a second portion. At least one of the first portion and the second portion being movable relative to the other one of the first portion and the second portion from the closed configuration to the open configuration. A toy is disposed in the toy package. A buoyancy system assists the toy package to move from the closed configuration to the open configuration when the buoyancy system is submerged in the liquid. The toy package can further include a water soluble film sealing the first portion to the second portions.

19 Claims, 21 Drawing Sheets

(56) References Cited

U.S. PATENT DOCUMENTS

| | | | | | |
|---|---|---|---|---|---|
| 4,277,908 | A * | 7/1981 | Nikaido | A63H 23/10 | 446/158 |
| 4,563,161 | A * | 1/1986 | Zimmerman | A63H 23/08 | 446/156 |
| 4,881,915 | A * | 11/1989 | Liaw | A63H 13/02 | 446/385 |
| 5,133,683 | A * | 7/1992 | Dorfman | B65D 65/46 | 428/34.3 |
| 5,273,476 | A | 12/1993 | Dorfman | | |
| 5,813,895 | A * | 9/1998 | Cho | G09B 23/36 | 446/385 |
| 6,409,569 | B1 * | 6/2002 | Boone | A63H 23/10 | 206/5 |
| 7,842,359 | B2 * | 11/2010 | Marlow | A41G 1/002 | 446/241 |
| 7,861,444 | B2 * | 1/2011 | Marlow | A41G 1/002 | 40/411 |
| 8,394,750 | B1 | 3/2013 | Forgash | | |
| 10,086,307 | B2 | 10/2018 | Duda et al. | | |
| 2006/0260973 | A1 | 11/2006 | Macinnes et al. | | |
| 2007/0045143 | A1 | 3/2007 | Clough et al. | | |
| 2007/0062964 | A1 | 3/2007 | Kampf et al. | | |
| 2008/0009220 | A1 * | 1/2008 | Simpson | A63H 3/26 | 446/175 |
| 2010/0136875 | A1 * | 6/2010 | Buynak | A63H 3/52 | 446/268 |

* cited by examiner

BUOYANCY ASSISTED TOY PACKAGING

TECHNICAL FIELD

This application relates to toy packaging. More specifically, the application relates to toy packaging configured for partial submersion in a liquid as part of an unboxing experience for the toy.

DISCUSSION OF THE RELATED ART

Unboxing has become a recent phenomenon in the toy industry. A memorable unboxing experience that engages the customer can help companies connect with the customer and create a positive buying experience. Customers having memorable unboxing experiences may record and share their experiences with potential customers increasing sales. In this way, there is a need for not only desirable toys but also for innovative and interactive toy packaging for the toy that engages customers.

SUMMARY

An aspect is directed to a toy packaging configured to be partially submerged in liquid to cause the toy packaging to move from a closed configuration to an open configuration. The toy packaging includes a first portion supported by a second portion, at least one of the first portion and the second portion being movable relative to the other one of the first portion and the second portion from the closed configuration to the open configuration, the first portion and the second portion defining a receptacle when in the closed configuration. The toy packaging further includes a toy disposed in the receptacle at least when the toy packaging is in the closed configuration and at least partially submerged in the liquid and a buoyancy system supported by at least one of the first portion and the second portion and configured to assist the toy packaging to move from the closed configuration to the open configuration when the buoyancy system is submerged in the liquid.

A variation of the aspect above is, wherein the first portion and the second portion form a seam when in the closed configuration, and wherein the toy packaging opens at the seam when the toy packaging moves from the closed configuration to the open configuration.

A variation of the aspect above is, further comprising a film disposed across at least a portion of the seam to prevent the toy packaging from moving to the open configuration, the film being configured to dissolve when submerged in liquid to allow the buoyancy system to assist the toy packaging system to move from the closed configuration to the open configuration.

A variation of the aspect above is, further comprising a handle, the handle configured to be disposed above the liquid when the toy packaging is at least partially submerged in the liquid.

A variation of the aspect above is, wherein the opening of the toy packaging includes a bottom opening portion and a side opening portion, the liquid entering the receptacle through the bottom opening and the toy exiting the receptacle through the side opening when the toy packaging is at least partially submerged in the liquid and in the open configuration.

A variation of the aspect above is, wherein the opening of the toy packaging includes a bottom opening portion and a side opening portion, and wherein the at least a portion of the seam is disposed over the bottom opening portion.

A variation of the aspect above is, wherein the buoyancy system comprises one or more chambers.

A variation of the aspect above is, wherein the one or more chambers comprises two chambers, and wherein the two chambers are disposed on the first portion and the second portion.

A variation of the aspect above is, wherein each of the one or more chambers defines a volume of gas, the gas having a lower density that the liquid.

A variation of the aspect above is, wherein at least one of the first portion or the second portion comprises a hole, the hole being sized and shaped to allow the liquid to the enter the receptacle when the hole is at least partially submerged in the liquid.

A variation of the aspect above is, wherein the toy comprises a sensor, and wherein the sensor is configured to activate the toy when the sensor is contacted with the liquid.

A variation of the aspect above is, further comprising a support disposed in the receptacle, the support immobilizing the toy when the toy packaging is in the closed configuration and releasing the toy when the toy packaging is in the open configuration.

A variation of the aspect above is, wherein the first portion and the second portion are supported by a hinge.

A variation of the aspect above is, further comprising a spring, wherein the spring is configured to assist the toy packaging to move from the closed configuration to the open configuration.

Another aspect is directed to method for unboxing a toy from a toy package while the toy package is submerged in a liquid. The toy package includes a buoyancy system. The method includes partially submerging the toy package in liquid, flowing the liquid through a wall of the submerged toy package, separating a first portion from a second portion of the toy package by the submerged buoyancy system to form an opening in the toy package without user intervention, activating a swimming action of the toy, and exiting the toy from the toy package through the opening without user intervention.

Another aspect is directed to toy packaging configured to be partially submerged in liquid to cause the toy packaging to move from a closed configuration to an open configuration. The toy packaging comprises a handle, a first portion rotatably coupled to the handle and movable from the closed configuration to the open configuration, the first portion having a first sealed gas chamber, and a second portion rotatably coupled to the handle and movable from the closed configuration to the open configuration, the second portion having a second sealed gas chamber. The first portion and the second portion define a receptacle when in the closed configuration. The first sealed gas chamber and the second sealed gas chamber create a buoyancy force which assists the toy packaging to move from the closed configuration to the open configuration when the first sealed gas chamber and the second sealed gas chamber are submerged in the liquid.

A variation of the aspect above is, further comprising a toy disposed in the receptacle at least when the toy packaging is in the closed configuration and at least partially submerged in the liquid.

A variation of the aspect above is, further comprising a film contacting both the first portion and the second portion when the toy packaging is in the closed configuration, the film being configured to dissolve when submerged in liquid.

A variation of the aspect above is, wherein at least one of the first portion or the second portion comprises a hole, the hole being sized and shaped to allow the liquid to the enter the receptacle when the hole is at least partially submerged in the liquid.

BRIEF DESCRIPTION OF THE DRAWINGS

The features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will now be described with additional specificity and detail through use of the accompanying drawings.

DETAILED DESCRIPTION

The following detailed description is directed to certain specific embodiments. The invention(s) disclosed herein, however, can be embodied in a multitude of different ways as defined and covered by the claims. In this description, reference is made to the drawings, wherein like parts are designated with like numerals throughout. The features, aspects and advantages of the present invention will now be described with reference to the drawings of several embodiments that are intended to be within the scope of the development herein disclosed. These and other embodiments will become readily apparent to those skilled in the art from the following detailed description of the embodiments having reference to the attached figures, the invention not being limited to any particular embodiment(s) herein disclosed.

Figure 1:
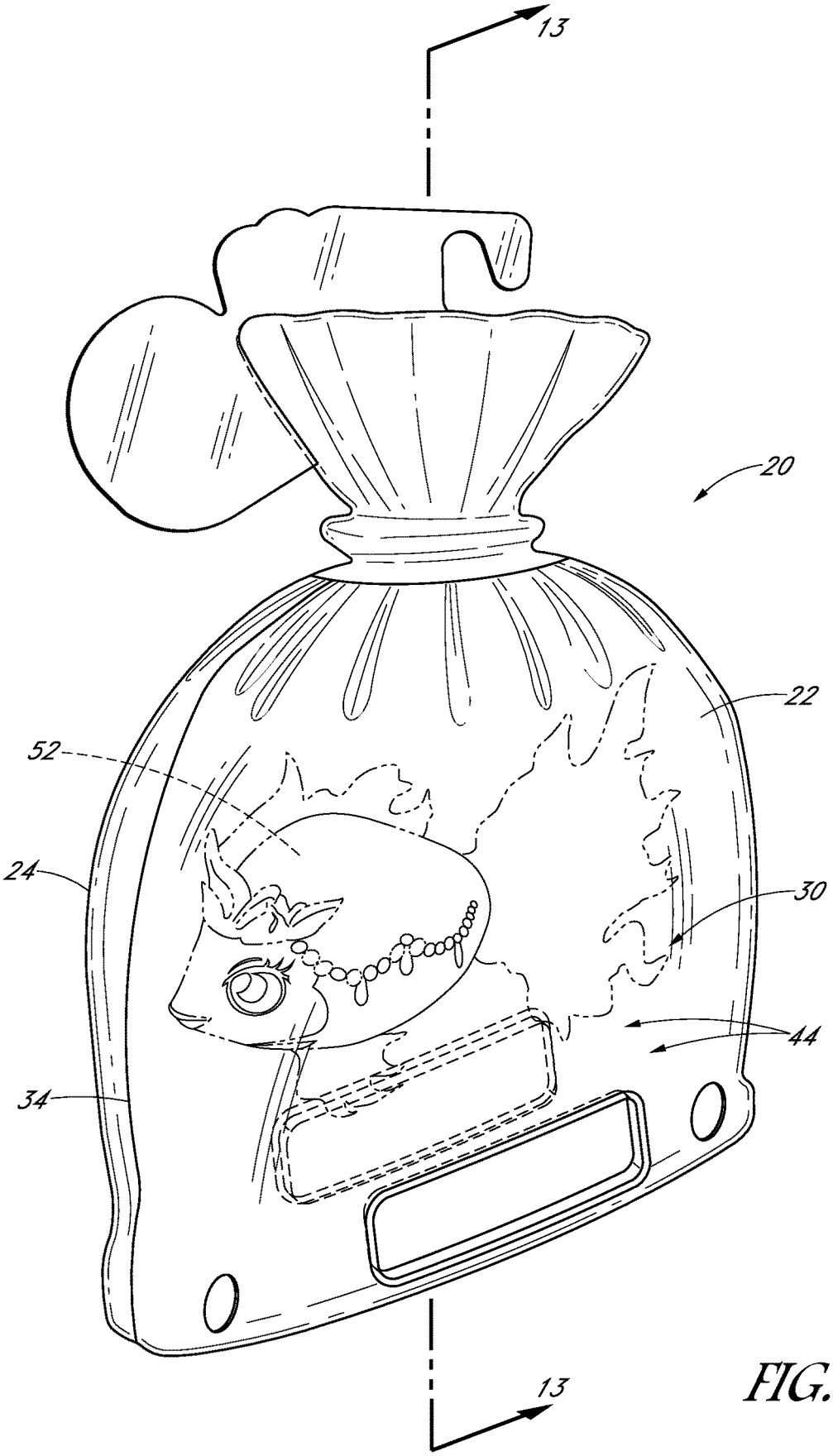
FIG. 1 is a front perspective view of a toy package containing a toy in a closed configuration according to a preferred embodiment of the present invention.

FIG. 1 is a front perspective view of a toy package 20 containing a toy 52 in a closed configuration according to a preferred embodiment of the present invention. The toy package 20 is designed to not only package the toy 52 for shipment and display, but to also provide an interactive unboxing experience for the customer. In certain embodiments to unbox the toy 52, the customer merely submerges the toy package 20 in a liquid, such as water. For ease of explanation, the liquid will be referred to as water. However, the invention is not so limited. The toy package 20 can be submerged in any other liquid or in any body of water, such as a sink, a bathtub, a swimming pool, a lake, or an ocean.

Figure 13:
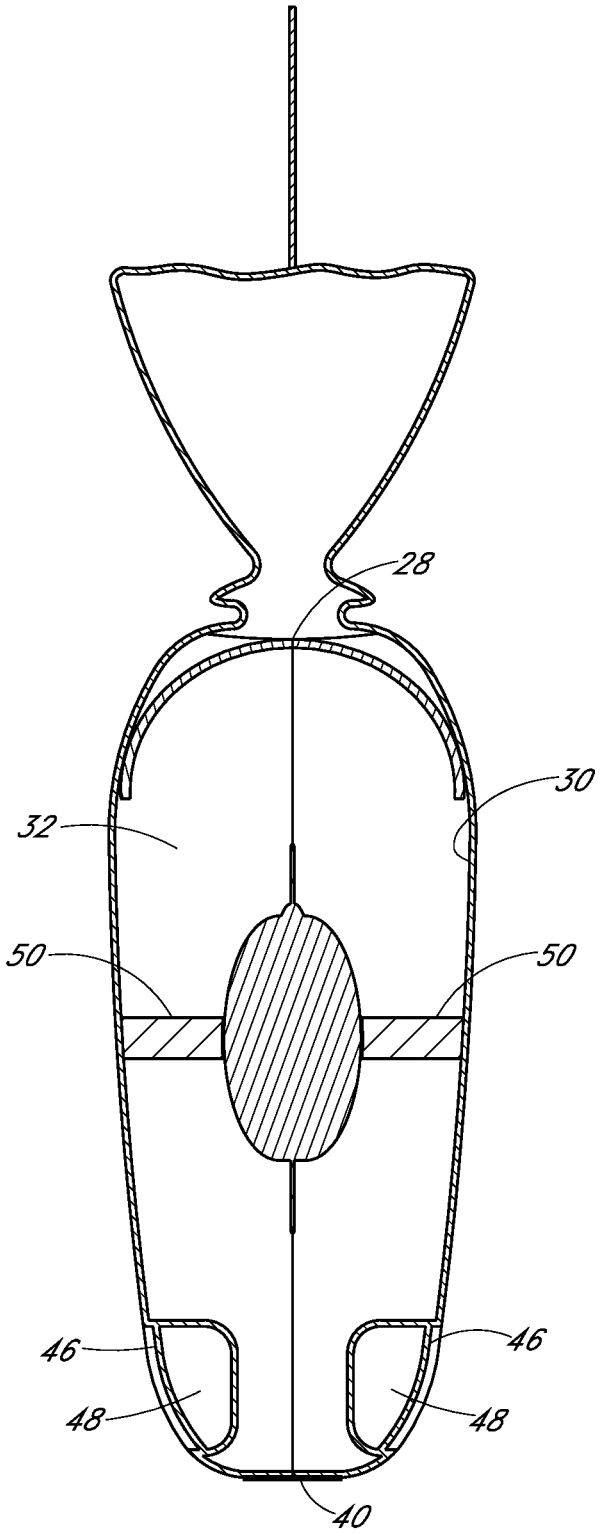
FIG. 13 is a cross-section view through the toy package of FIG. 1 along line 13-13.

After the toy package 20 is submerged in the water, the toy package 20 releases the toy 52 from a receptacle 32 disposed within an interior 30 of the toy package 20 without user intervention (see FIG. 13). In this way, once submerged, the toy package 20 automatically opens to release the toy 52 into the body of water to the amazement of the user.

In certain embodiments, the toy package 20 includes a buoyance system 44 which is configured to cause the toy package 20 to release the toy 52 without customer invention. In certain embodiments, the toy package 20 comprises a film 40. The film 40 prevents the toy package 20 from releasing the toy 52 until after the film 40 is dissolved by the same water that causes the toy package 20 to release the toy 52 without customer intervention.

In certain embodiments of the toy package 20 that include both the buoyancy system 44 and the film 40, the customer begins the unboxing experience by partially submerging the toy package 20 in the water. The unboxing experience concludes with the customer observing the toy 52 exiting the toy package 20 under its own power. In certain embodiments, the toy 52 is shaped like a fish that activates and begins making a swimming motion when contacted by the water.

Figure 2:
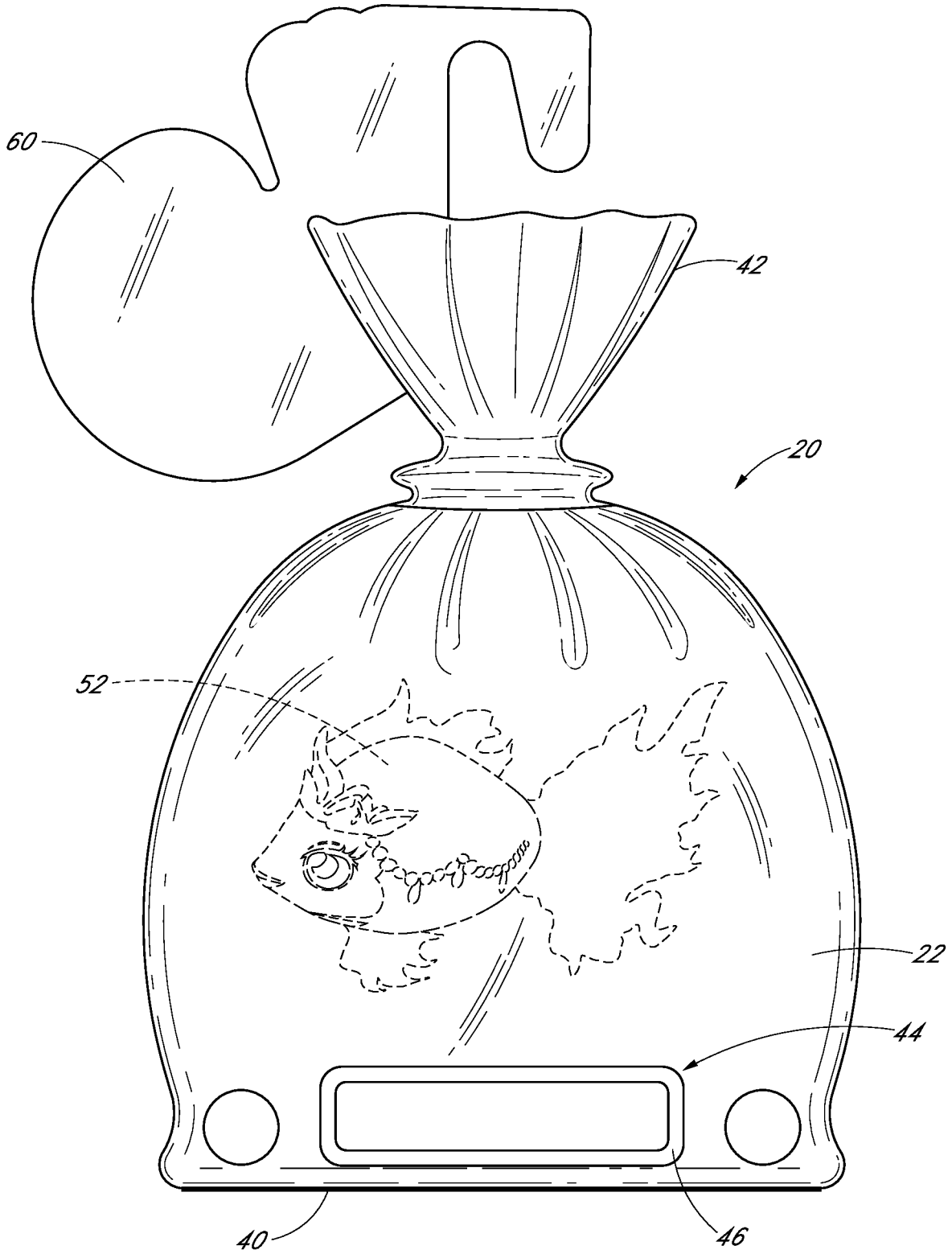
FIG. 2 is a plan front view of the toy package from FIG. 1.
Figure 3:
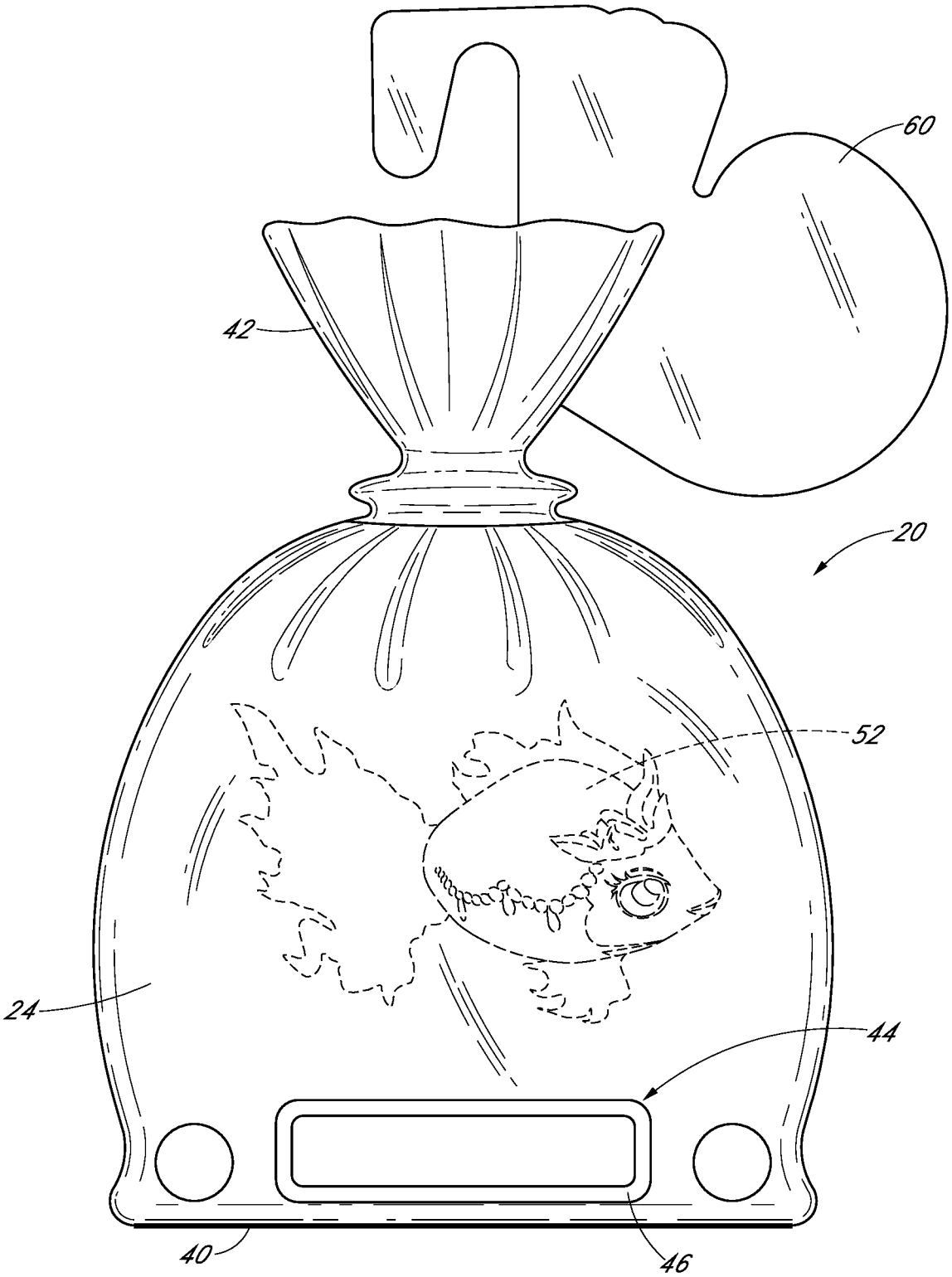
FIG. 3 is a plan back view of the toy package from FIG. 1.

FIG. 2 is a plan front view of the toy package 20 from FIG. 1. The toy package 20 can comprise plastic or any other material. In certain embodiments, the toy package 20 is injection molded plastic. FIG. 3 is a plan back view of the toy package 20 from FIG. 1. In the embodiment illustrated in FIGS. 2 and 3, the toy package 20 comprises a first portion 22 and a second portion 24 in a closed configuration. At least one of the first and second portions 22, 24 is movable relative to the other one of the first and second portions 22, 24 to open the toy package 20 and move to an open configuration. However, the toy package 20 can comprise more than two portions. In certain embodiments, the toy package 20 can comprise three or more portions. For example, the toy package 20 can comprises four portions with at least one of the four portions being configured to move so as to open the toy package 20. In certain embodiments, the portions of the toy package 20 are arrange symmetrically about the toy 52 like flower petals. One or more of the flower petals are configured to move relative to another one of the flower petals opening the toy package 20.

In certain embodiments, the toy package 20 comprises a handle 42. The handle 42 is sized and shaped for a user to grasp the toy package 20 and lower the toy package 20 into the water. The handle 42 has an ergonomic shape to allow the user to maintain control of the toy package 20 during the underwater unboxing of the toy 52. The handle 42 can be manufactured from the same or different material as the first and second portions 22, 24. The handle 42 can be solid or hollow.

In certain embodiments, the toy package 20 comprises a hanger 60. The hanger 60 is configured to support the toy package 20 when being displayed to potential customers. In certain embodiments, at least a portion of the hanger 60 includes a j-shape configured to hang on a hook. Of course, the shape of the hanger 60 is not so limited and can have a different shape which allows display of the toy package 20. In the illustrated embodiment, the hanger 60 is coupled to the handle 42. Of course, the hanger 60 need not be coupled to the handle 42 and instead can be coupled to the toy package 20 at a different location than the handle 42.

In the illustrated embodiment, both the first portion 22 and the second portion 24 are movable in a direction away from the toy 52. In certain embodiments that have the handle 42, both the first portion 22 and the second portion 24 are movable in a direction away from the handle 42. However, in certain embodiments, only one of the first and second portions 22, 24 is movable while the other portion is fixed relative to the toy 52. For example, in certain embodiments, the first portion 22 moves away from the toy 52 and relative to both the second portion 24 and the handle 42. In such an embodiment, the first portion 22 creates an opening for the toy 52 to exit the toy package 20.

As shown in FIGS. 2 and 3, the toy package 20 includes the buoyance system 44. In the illustrated embodiment, the buoyance system 44 is disposed in the interior 30 of the toy package 20. In other embodiments, the buoyance system 44 is disposed on the outside of the toy package 20. For example, the buoyance system 44 can be coupled to an outer surface of the toy package 20.

The buoyance system 44 is configured to cause the toy package 20 to release the toy 52 without customer invention. In certain embodiments, the buoyance system 44 comprises one or more chambers 46. In certain embodiments, the one or more chambers 46 are molded into each half (the first portion 22 and the second portion 24) of the toy package 20.

In the illustrated embodiment, each of the first portion 22 and the second portion 24 comprises one chamber 46 disposed near the bottom of the toy package 20. The one or more chamber 46 cause the first and second portions 22, 24 to separate or move away from the toy 52 to open the toy package 20 and move to the open configuration. In certain embodiments, one or both of the first portion 22 and the second portion 24 comprise more than one chamber 46.

Figure 4:
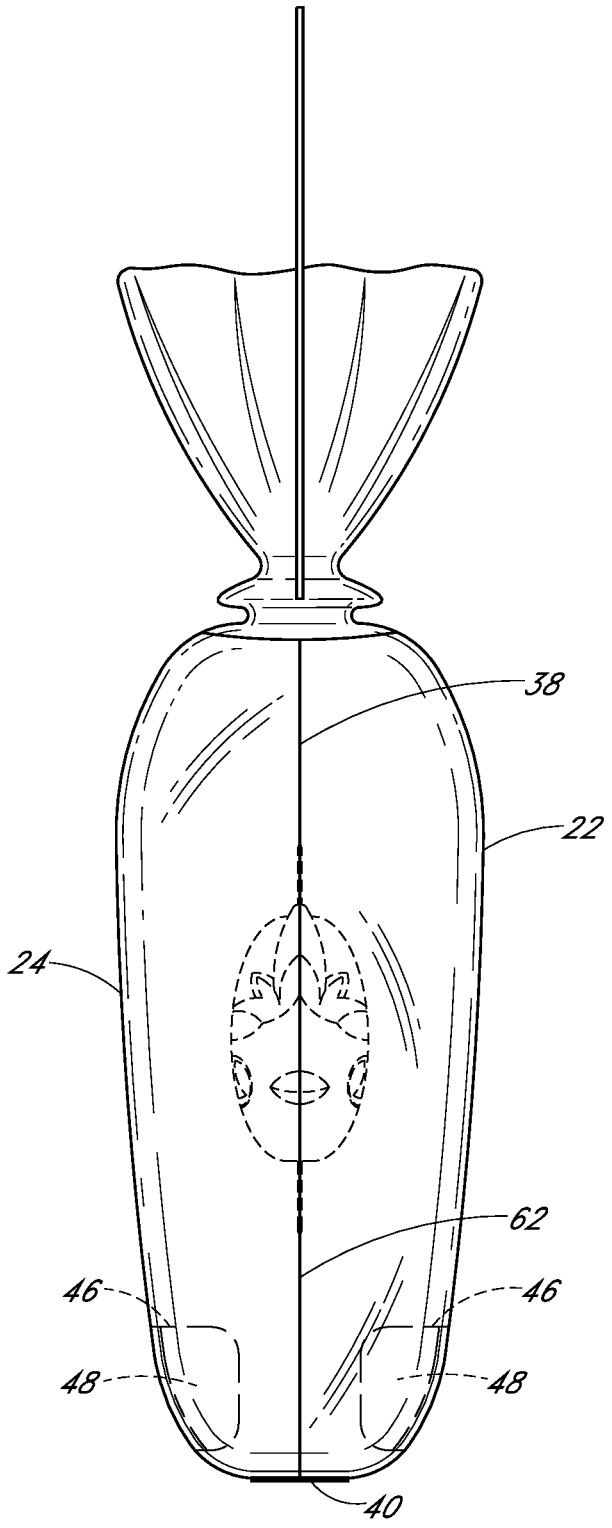
FIG. 4 is a side view of the toy package from FIG. 1.
Figure 5:
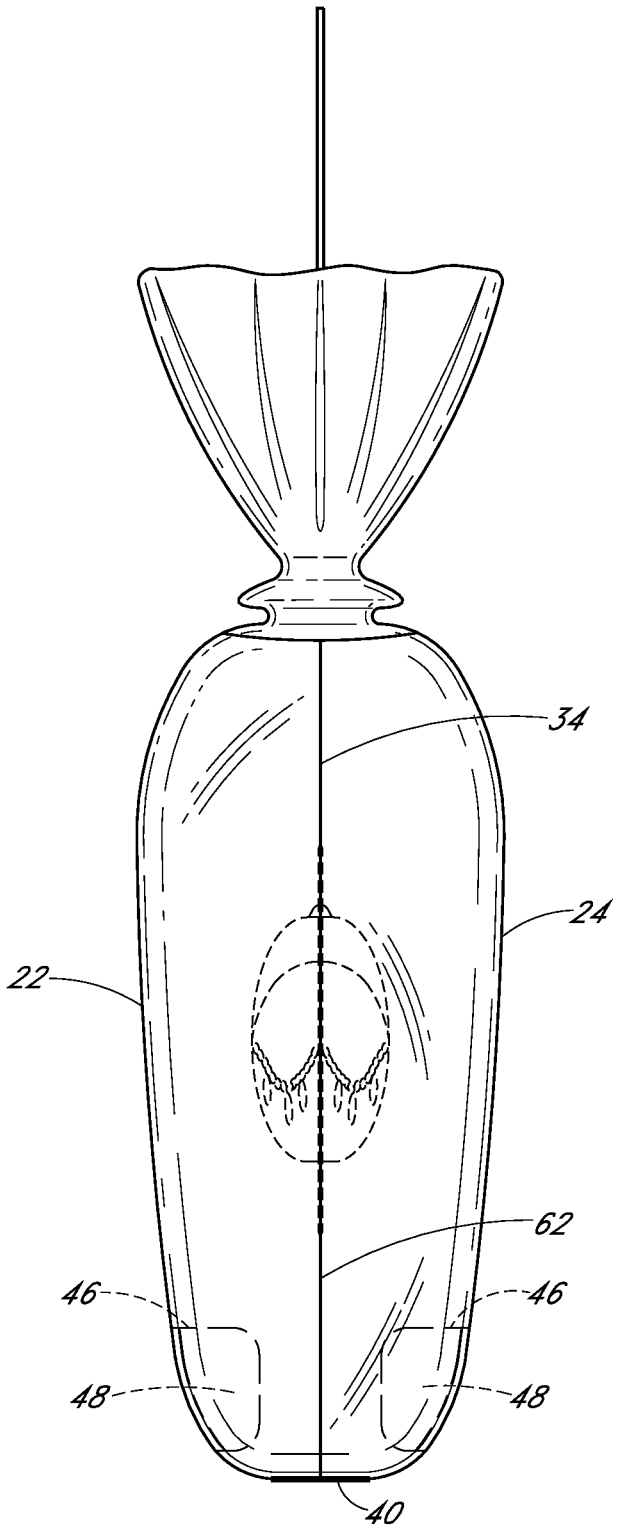
FIG. 5 is an opposite side view of the toy package from FIG. 1.

FIG. 4 is a side view of the toy package 20 from FIG. 1. FIG. 5 is an opposite side view of the toy package 20 from FIG. 1. As is illustrated in FIGS. 4 and 5, a seam 34 is formed at the interface between the first portion 22 and the second portion 24 when the toy package 20 is in the closed configuration. A length of the seam 34 can extend for the entire length of the interface between the first portion 22 and the second portion 24. In certain embodiments, the length of the seam 34 extends for less that the length of the entire interface between the first portion 22 and the second portion. As explained below in certain embodiments, the length of the seam 34 may exclude a length of one or more hinges 28 connecting the first and second portions 22, 24 to the toy packaging 20.

In certain embodiments, the seam 34 defines a gap 62 between the first portion 22 and the second portion 24 when the toy package 20 is in the closed configuration. In certain embodiments, the gap 62 has little to no width. In certain embodiments, the width of the gap 62 is selected to allow water to slowly enter the toy package 20 when the toy package 20 is submerged in the water.

In certain embodiments in the open configuration (see FIG. 14), the first portion 22 and the second portion 24 define a bottom opening 36 and two side openings 38. In certain embodiments, the seam 34 comprises both the bottom opening 36 and the two side openings 38. In certain embodiments, at least one of the side openings is sized and shaped to allow the toy 52 to pass through the side opening 38 and exit the toy package 20. In other embodiments, the bottom opening 36 is sized and shaped to allow the toy 52 to pass through the bottom opening 36 and exit the toy package 20 in a downward direction.

As is illustrated in FIGS. 4 and 5, each chamber of the one or more chambers 46 defines a volume 48. The volume has a density (ratio of mass to volume) that is preferably less than the density of the water. When the volume 48 is submerged below the water, the difference of the density of the volume 48 and the density of the water gives rise to a buoyancy force on the toy package 20. If the density is less than that of the water, the volume 48 will cause the toy package 20 to float upward due to the buoyancy from the water. The toy package 20 would float to the top of the water and only be submerged by an amount related to the ratio of the densities. However, as explained below, the upward force provided by the buoyancy system 44 causes only the first and second portions 22, 24 to float upwards while the remainder of the toy package 20, including the toy 52, stays submerged in the water.

In certain embodiments, the one or more chambers 46 are filled with a gas. For example, the gas can be air or any other gas. In certain embodiments, the one or more chambers 46 are filled by a material. For example, the material can be foam or any other material that has a density less than the liquid. In certain embodiments, the one or more chambers 46 are filled with a combination of a gas and a material.

In certain embodiments, the one or more chambers 46 are sealed around the volume 48. In embodiments where the volume 48 is filled with a gas, sealing the one or more chambers 46 ensures gas does not escape from the one or more chambers 46 regardless of the orientation of the toy package 20 when the user submerges the toy package 20 into the water. In certain embodiments where the one or more chambers 46 are filled by a material, the one or more chambers 46 can be unsealed.

In certain embodiments, the one or more chambers 46 have one or more holes (not shown). In certain embodiments, the one or more holes are located on a lower surface of the one or more chambers 46 to inhibit the water from entering the volume 48 and displacing the gas from the one or more chambers 46 as the toy package 20 is submerged in the water.

In certain embodiments, the one or more holes are located on an upper or side surface of the one or more chambers 46 which allows the water to enter the volume 48 and displace the gas from the one or more chambers 46. In embodiments where the one or more chambers 46 have holes, the one or more holes are sized to sufficiently slow the flow of liquid into the one or more chambers 46 and provide an adequate buoyance force to move the toy package 20 to the open configuration. With correctly sized holes in the one or more chambers 46, the rate at which the buoyance force is reduced as the water enters the one or more chambers 46 can be slow enough to still allow the toy packaging 20 to reach the open configuration before the one or more chambers 46 are completely filled with the water.

Figure 6:
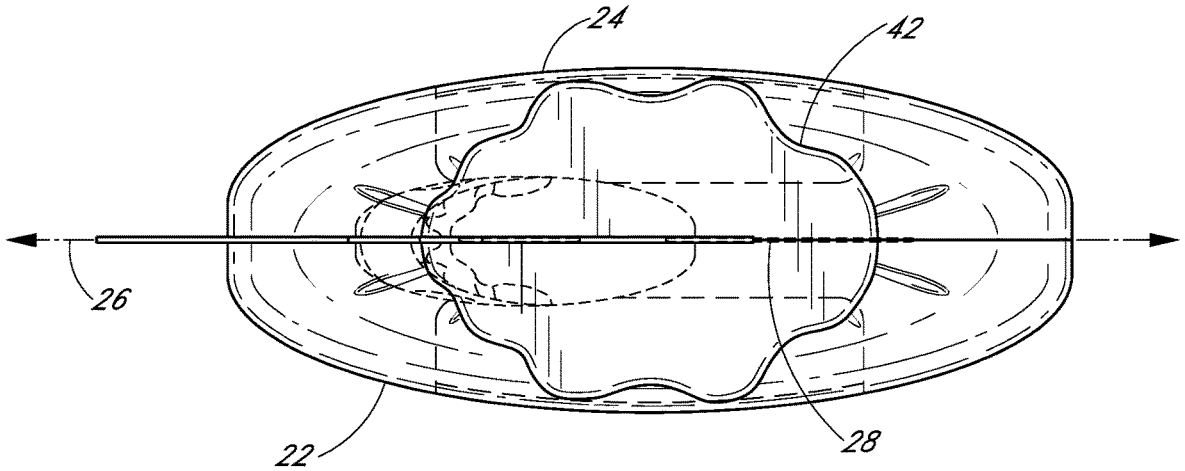
FIG. 6 is a top view of the toy package from FIG. 1.

FIG. 6 is a top view of the toy package 20 from FIG. 1. As illustrated, the toy package 20 can include the handle 42. The handle 42 can be sized and shaped for the user to grasp the toy package 20 and lower the toy package 20 into the water. In the illustrated embodiment, the handle 42 has a bulbous distal end and narrows in a direction towards the first and second portion 22, 24. In certain embodiments, the handle 42 is coupled to each of the first and second portions 22, 24 along an axis 26.

Figure 14:
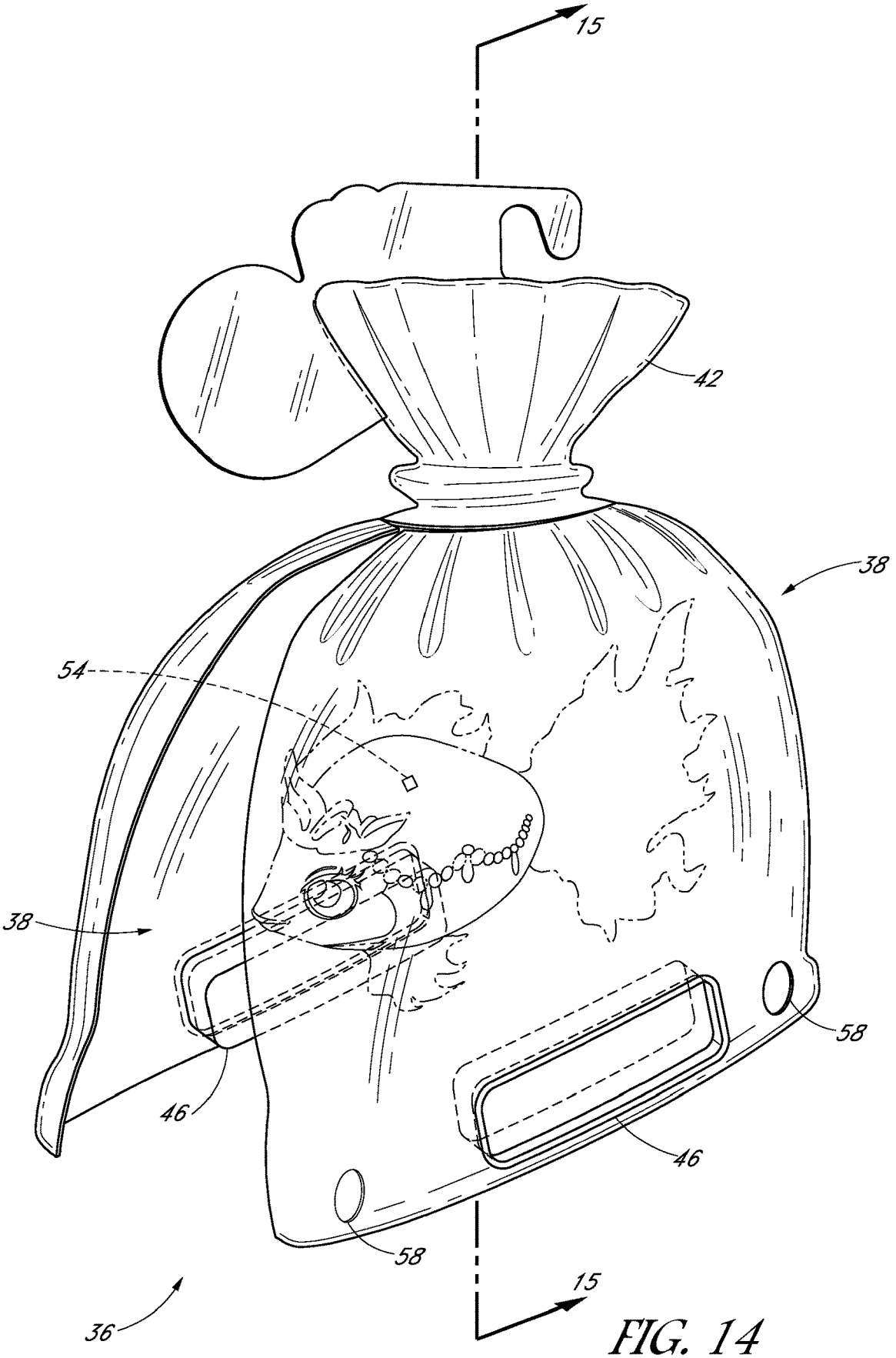
FIG. 14 is similar to FIG. 1 except the toy package is in an open configuration.

In the illustrated embodiment, the handle 42 couples to the first and second portions 22, 24. In certain embodiments, the handle 42 couples to the first and second portions 22, 24 via the one or more hinges 28 disposed along the axis 26. The first and second portions 22, 24 can be configured to rotate about their respective hinge 28 or the same hinge 28 between the closed configuration (FIG. 1) and the open configuration (FIG. 14). In certain embodiments, the one or more hinge 28 is a living hinge. In other embodiments, the one or more hinge 28 is a separate hinge that is coupled between the handle 42 and each of the first and second portions 22, 24.

In the illustrated embodiment, the first and second portions 22, 24 are coupled to the handle 42 when the toy package 20 is in both the closed and open configurations. When moving from the closed configuration to the open configuration, each of the first and second portions 22, 24 rotates about their respective axis 26.

In certain embodiments, the first and second portions 22, 24 are coupled to the handle 42 when in the closed configuration but then separate entirely from the handle 42 when in the open configuration. In this way, the buoyance system 44 creates a force which not only opens the toy package 20 while also separating the entire first and second portions 22, 24 from the handle 42.

Figure 7:
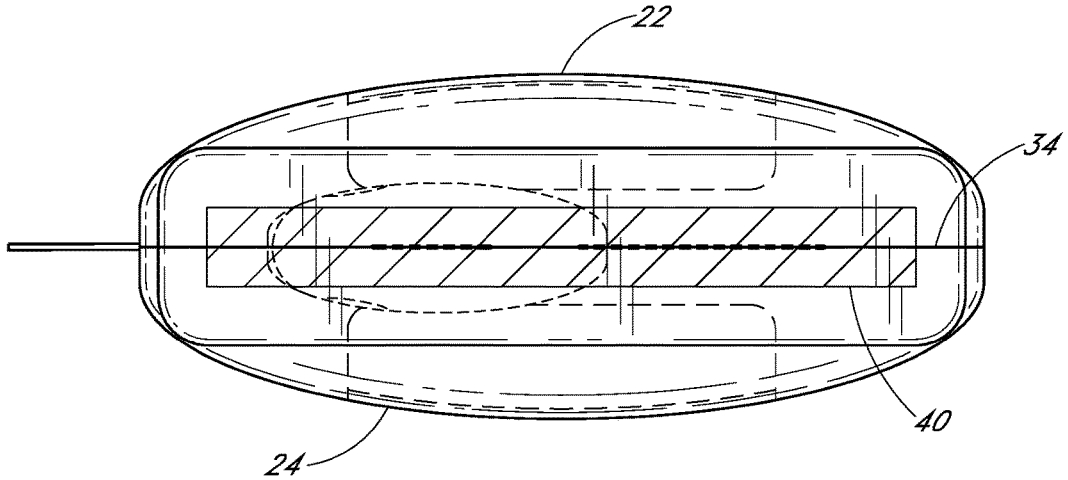
FIG. 7 is a bottom view of the toy package from FIG. 1 covered by a film.

FIG. 7 is a bottom view of the toy package 20 from FIG. 1 covered by the film 40. In certain embodiments, the film 40 is a tape. In certain embodiments, the film 40 prevents the toy package 20 from releasing the toy 52 until after the film 40 is dissolved by the same water that causes the toy package 20 to release the toy 52 without customer intervention.

In certain embodiments, the film 40 comprises a water soluble material. In certain embodiments, the film 40 comprises a dissolvable material. In certain embodiments, the film 40 is disposed across at least a portion of the seam 34 to prevent the toy packaging 20 from moving to the open configuration. In certain embodiments, the film 40 is only placed over portions of the seam 34 that are submerged in water during unboxing. In the illustrated embodiment, the film 40 is disposed over a portion of the seam 34 that extends along the bottom opening 36. In the illustrated embodiment, the film 40 is not placed over a portion of the seam 34 that extends along the two side openings 38. Once contacted with water, the film 40 dissolves to allow the buoyancy system 44 to cause the toy package 20 to move from the closed configuration to the open configuration when the toy package 20 is submerged in the water.

Figure 8A:
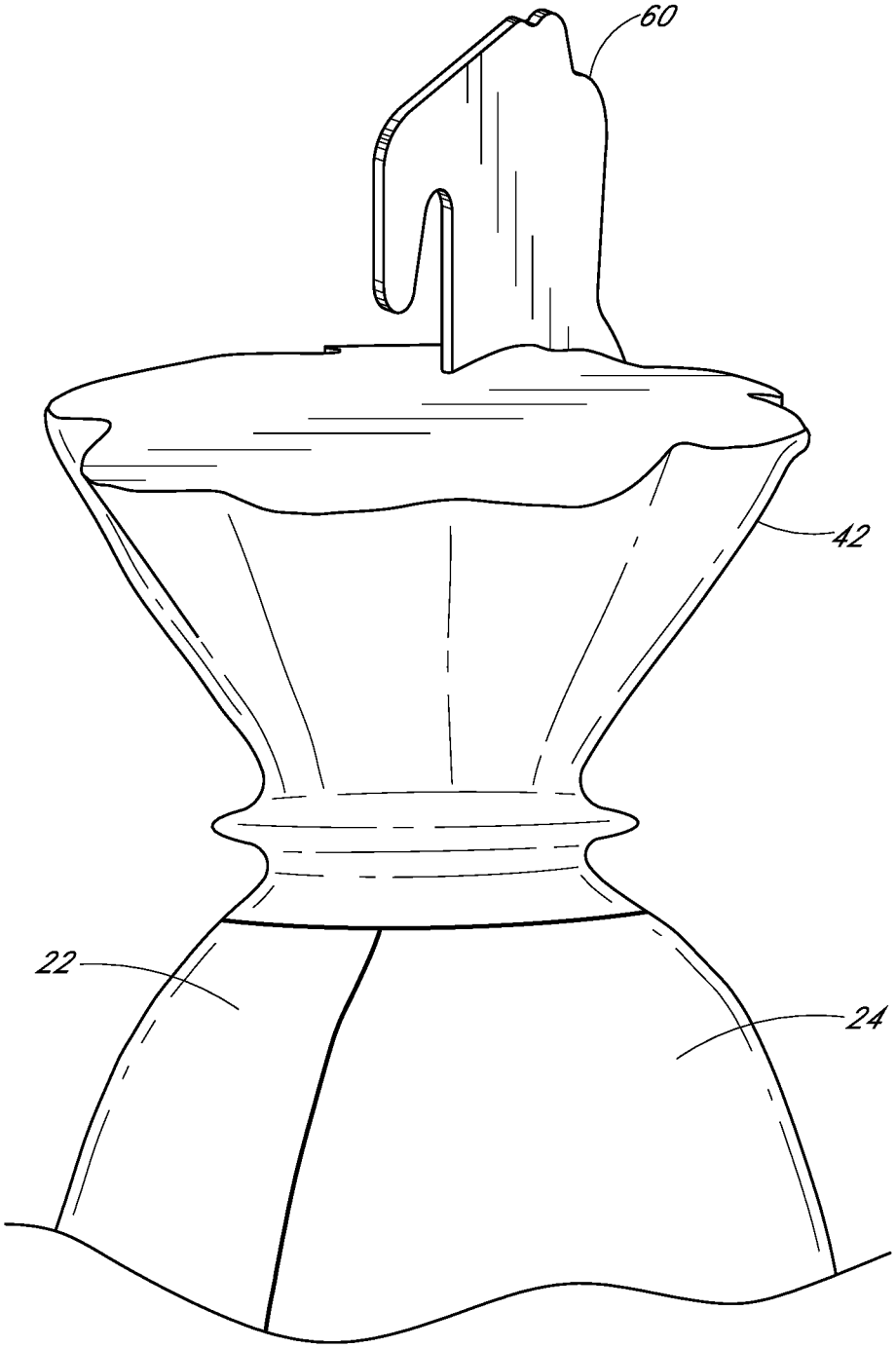
FIG. 8A is an enlarged view of an embodiment of a handle portion of the toy package.
Figure 8B:
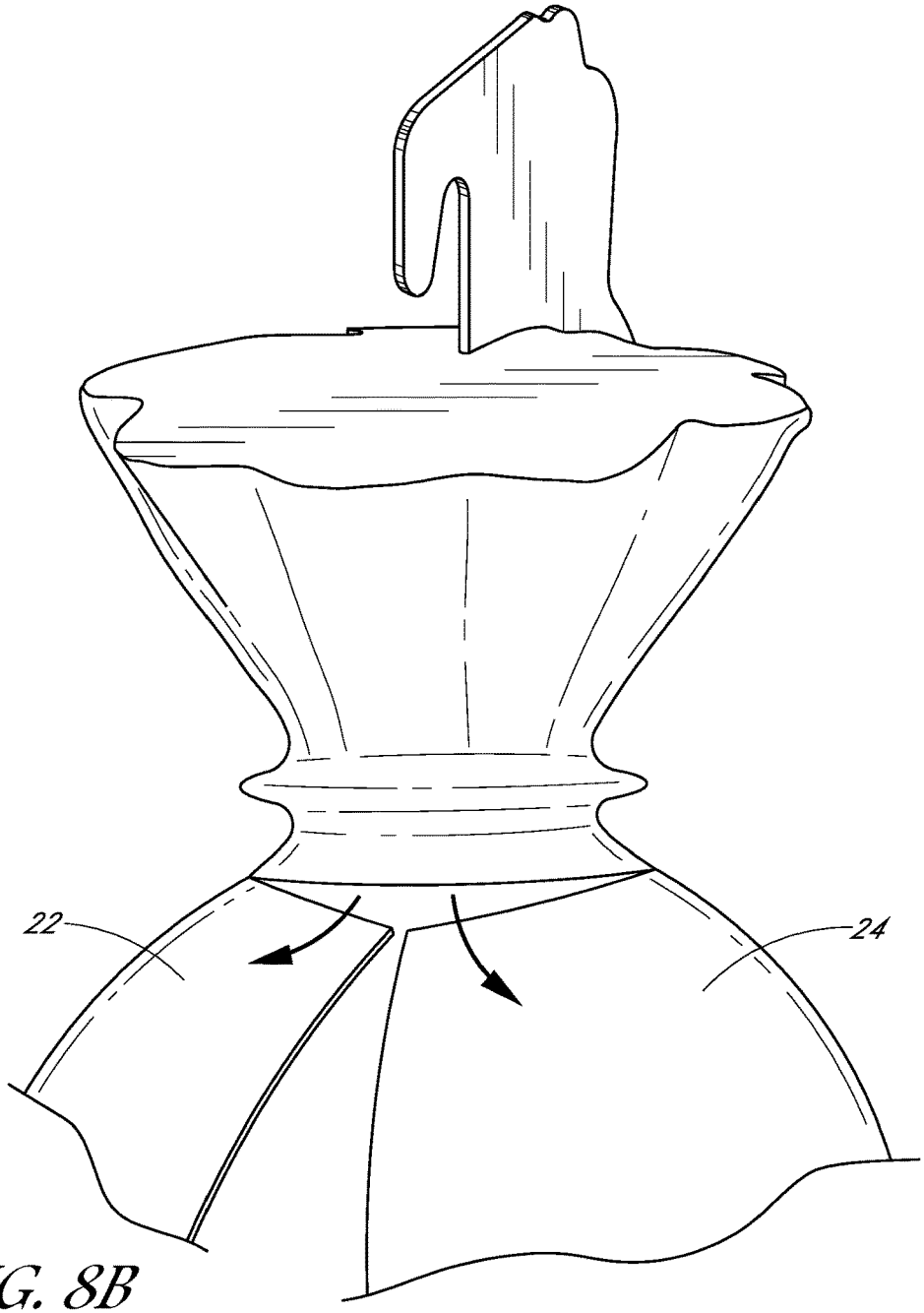
FIG. 8B is similar to FIG. 8A except the first portion is partially separated from the second portion.
Figure 8C:
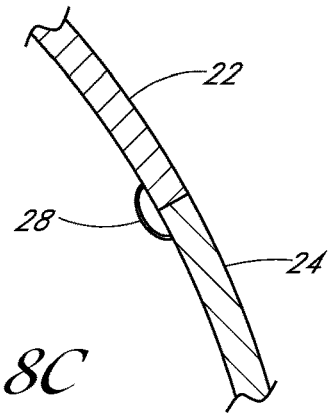
FIG. 8C is an enlarged view of a hinge in a closed condition and connected between the first portion and the second portion of the toy package.
Figure 8D:
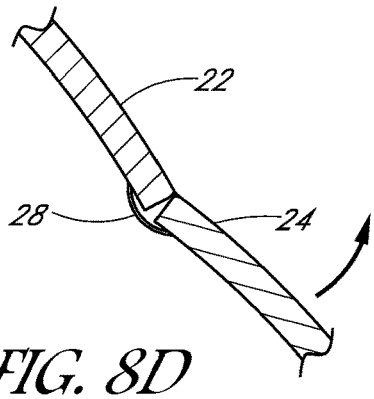
FIG. 8D is an enlarged view of the hinge in a slightly opened condition and connected between the first portion and the second portion of the toy package.

FIG. 8A is an enlarged view of an embodiment of the handle 42 portion of the toy package 20. FIG. 8B is similar to FIG. 8A except the first portion 22 is partially separated from the second portion 24. In the illustrated embodiment, the first and second portions 22, 24 are coupled to the handle 42 when the toy package 20 is in both the closed and open configurations. FIG. 8C is an enlarged view of a hinge 28 in a closed condition and connected between the first portion 22 and the second portion 24 of the toy package 20. FIG. 8D is an enlarged view of the hinge 28 in a slightly opened condition and connected between the first portion 22 and the second portion 24 of the toy package 20. When moving from the closed configuration to the open configuration, each of the first and second portions 22, 24 rotates about the axis 26 defined by the hinge 28.

Figure 9:
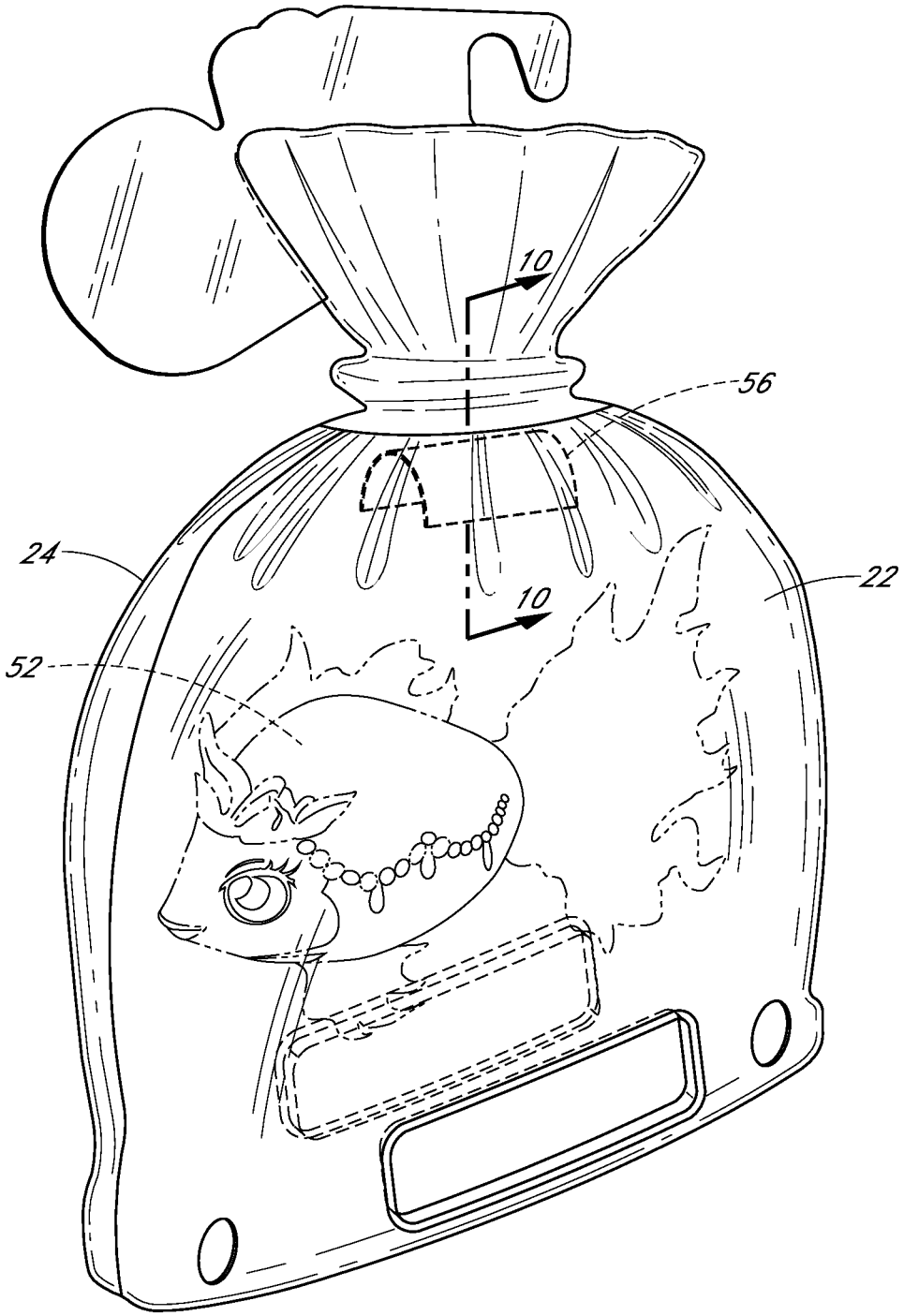
FIG. 9 is view of another embodiment of the toy package showing a hinge in combination with a spring.

FIG. 9 is view of another embodiment of the toy package 20 showing a hinge 28 in combination with a spring 56. In certain embodiments, the toy package 20 comprises one or more springs 56. In certain embodiments, the one or more springs 56 are injection molded. In certain embodiments, the one or more springs 56 are configured to assist the buoyancy system 44 moving the toy package 20 from the closed configuration to the open configuration.

Figure 10A:
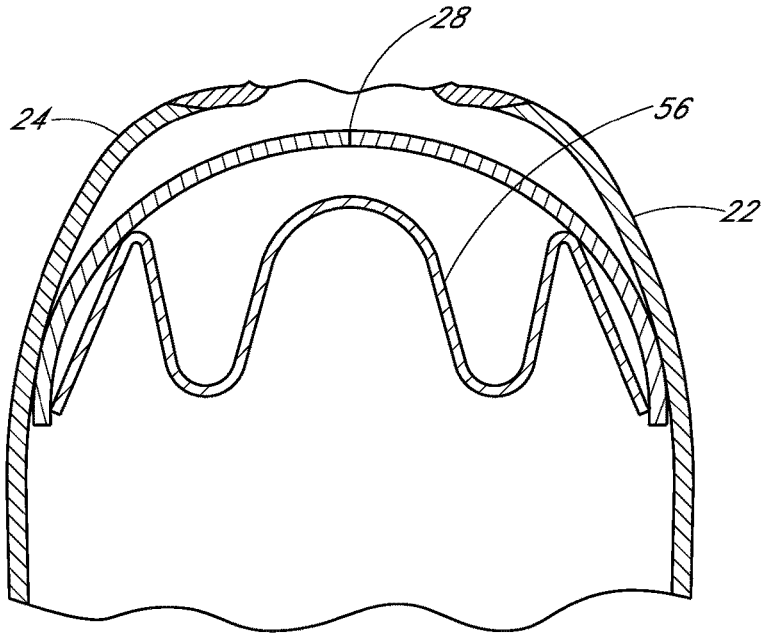
FIG. 10A is a cross-section view along line 10-10 in FIG. 9 showing the hinge and the spring from FIG. 9 in a closed condition.
Figure 10B:
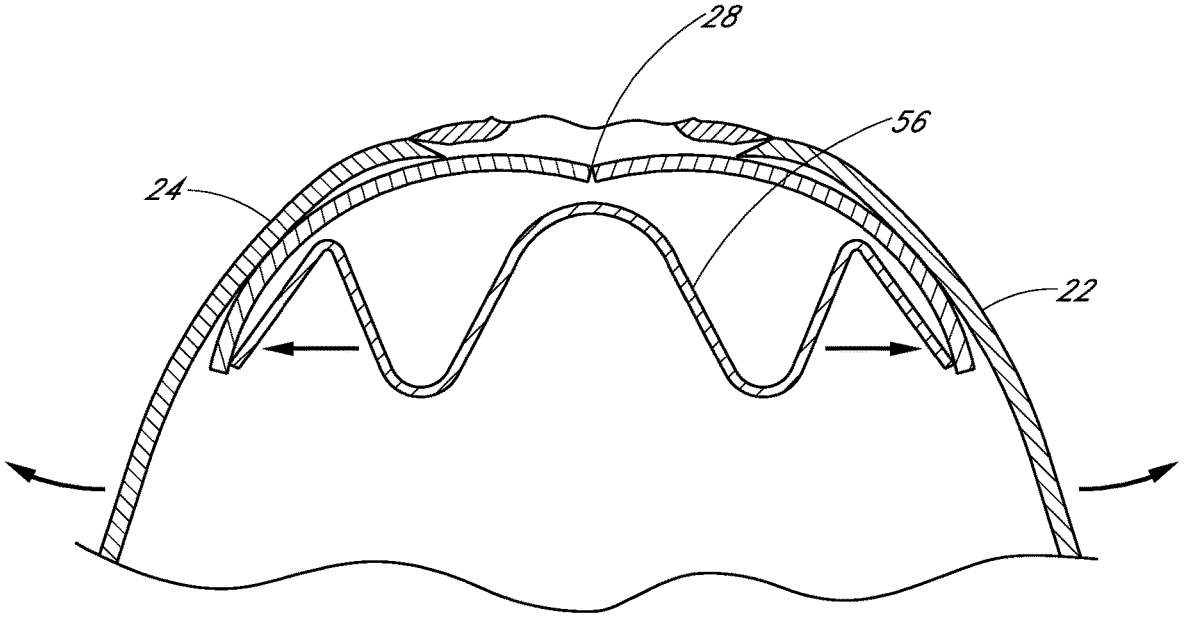
FIG. 10B is similar to FIG. 10A except the hinge is in a slight opened configuration.

FIG. 10A is a cross-section view along line 10-10 in FIG. 9 showing the hinge 28 and the spring 56 from FIG. 9 in a closed condition. FIG. 10B is similar to FIG. 10A except the hinge 28 is in a slight opened configuration. In certain embodiments, the one or more springs 56 bias the first and second portions 22, 24 to pivot away from the handle 42 and towards the open configuration. In this way, the one or more springs 56 and the buoyancy system 44 together move the toy package 20 to the open configuration.

Figure 11:
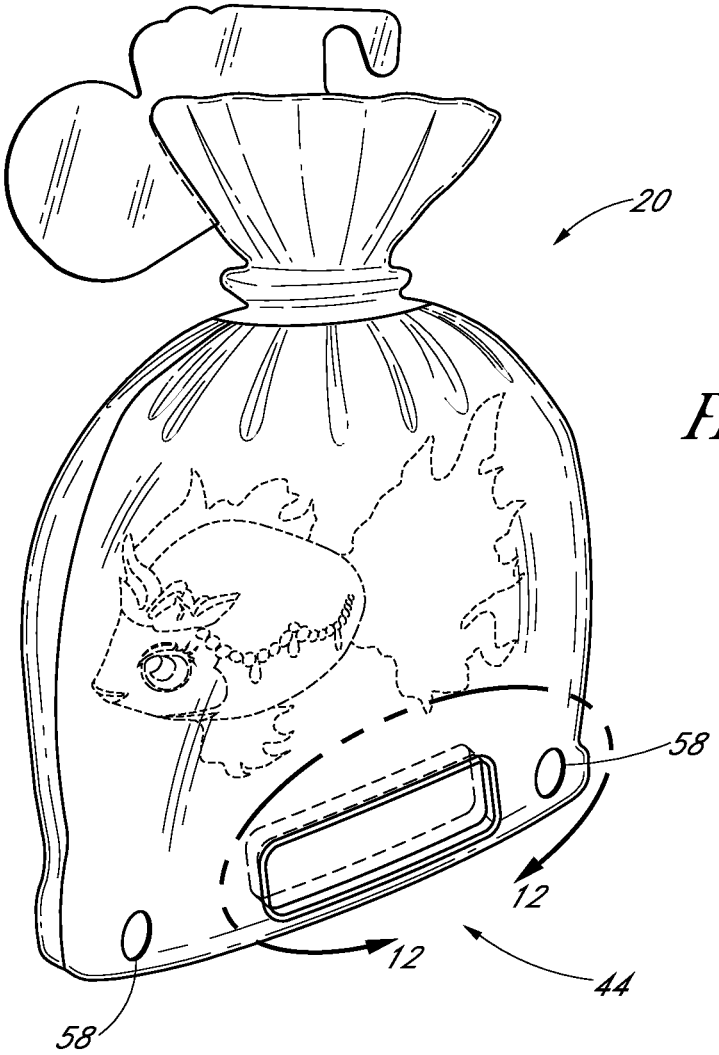
FIG. 11 is a view of the front of the toy package.
Figure 12:
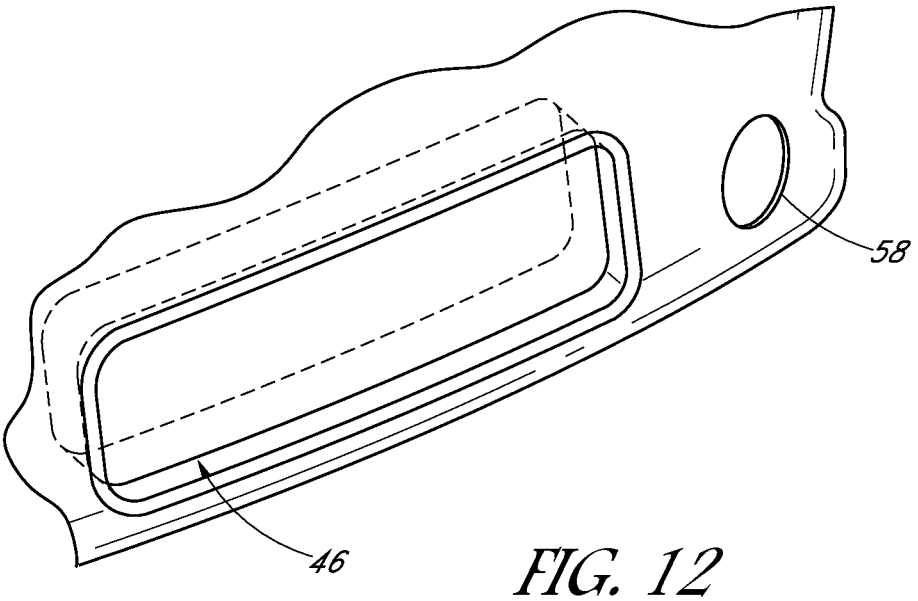
FIG. 12 is an enlarged view of a portion of FIG. 11 and shows a buoyancy system and one or more holes disposed in the toy package.

FIG. 11 is a view of the front of the toy package 20. FIG. 12 is an enlarged view of a portion of FIG. 11 and shows the buoyancy system 44 and one or more holes 58 disposed in the toy package 20. In the illustrated embodiment, there are four holes 58 in the toy package 20 to allow the water to enter the interior 30 when dipped or submerged under the water. Of course, there can be more or less than four holes 58 in the toy package 20.

The one or more holes 58 are sized and shaped to allow the water to enter the interior 30 of the toy package 20. In certain embodiments, the water slowly fills the interior 30 but does not fill the one or more chambers 46 of the buoyancy system 44. Once the interior 30 is filled and the water is on opposite sides of the first and second portions 22, 24, the buoyance system 44 causes the first and second portions 22, 24 to move to the open configuration without user intervention. In certain embodiments, without the buoyancy system 44, the first and second portions 22, 24 would not move to the open configuration.

In certain embodiments, centers of the one or more chambers 46 are located outside a region between two vertical planes passing through the axes 26. In this way, the buoyancy force in the upward direction creates a moment which causes the first and second portions 22, 24 to rotate about the axes 26 and toward the open configuration.

FIG. 13 is a cross-section view through the toy package 20 of FIG. 1 along line 13-13. As is illustrated in FIG. 13, the each of the one or more chambers 46 of the buoyancy system 44 has a generally triangular cross-sectional shape. However, the disclosure is not so limited. The one or more chambers 46 can have any other shape including, rectangular, oblong, round, and square.

As is illustrated in FIG. 13, the toy 52 is disposed in the toy package 20. In certain embodiments, the toy 52 sits within a support 50 that is disposed within the receptacle 32 of the toy package 20. In certain embodiments, the support 50 is configured to immobilize the toy 52 while the toy package 20 is in the closed configuration.

Figure 15:
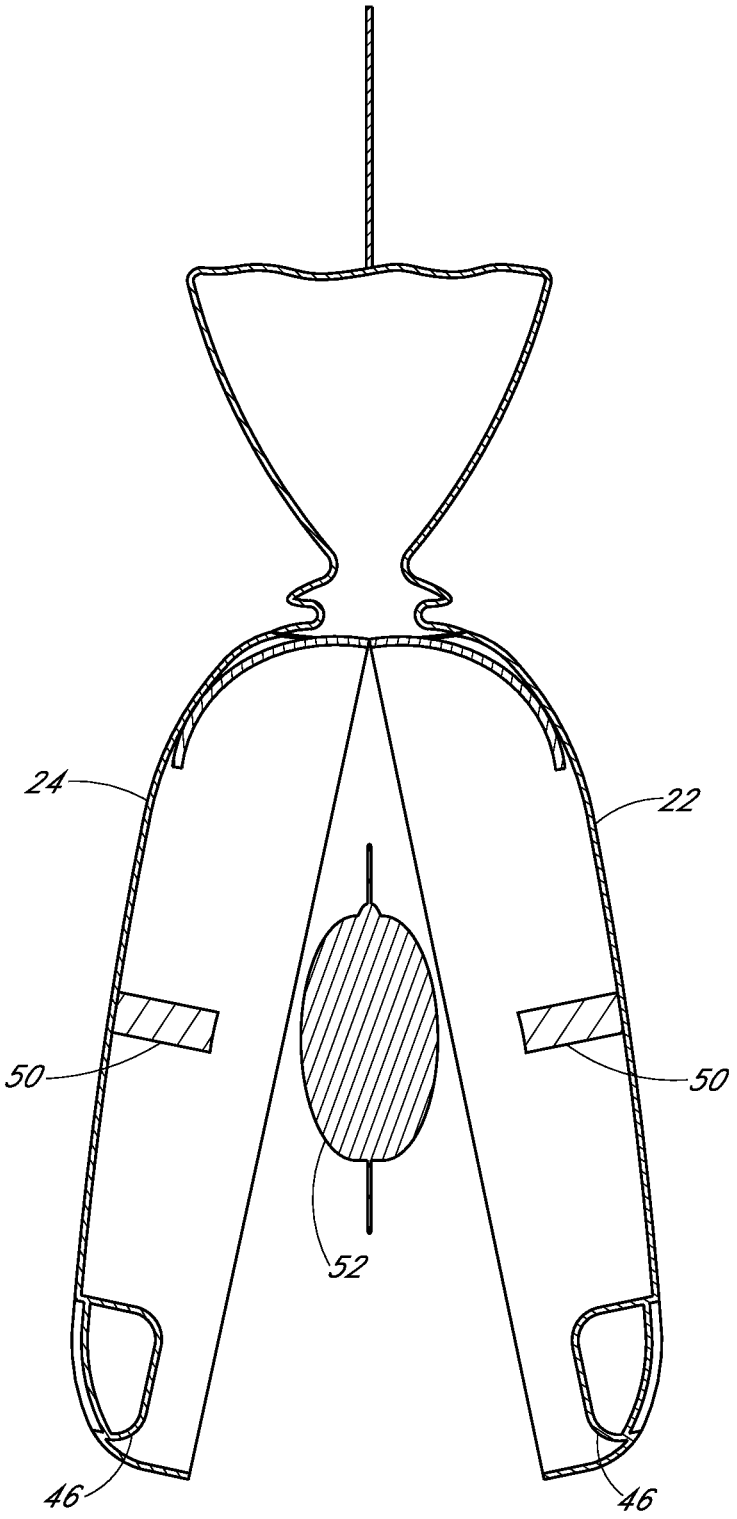
FIG. 15 is a cross-section view through the toy package of FIG. 14 along line 15-15.

FIG. 14 is similar to FIG. 1 except the toy package 20 is in the open configuration. FIG. 15 is a cross-section view through the toy package 20 of FIG. 14 along line 15-15. As illustrated in FIGS. 14 and 15, as the toy package 20 moves to the open configuration, the support 50 disengages from the toy 52 releasing the toy 52. Once the toy 52 is disengaged from the support 50, the toy 52 is able to exit the toy package 20. In certain embodiments, the toy 52 comprises a water sensor 54 that senses when the water contacts the toy 52. For example, the water sensor 54 can be configured as a capacitive sensor. After the water sensor 54 senses water, the water sensor 54 sends a signal to the toy 52 to begin a predefined action. In certain embodiments, the predefined action is a swimming action. However, the disclosure is not so limited. The predefined action could be any other action including any other movement besides swimming, a sound, or an emission of light, for example.

Figure 16:
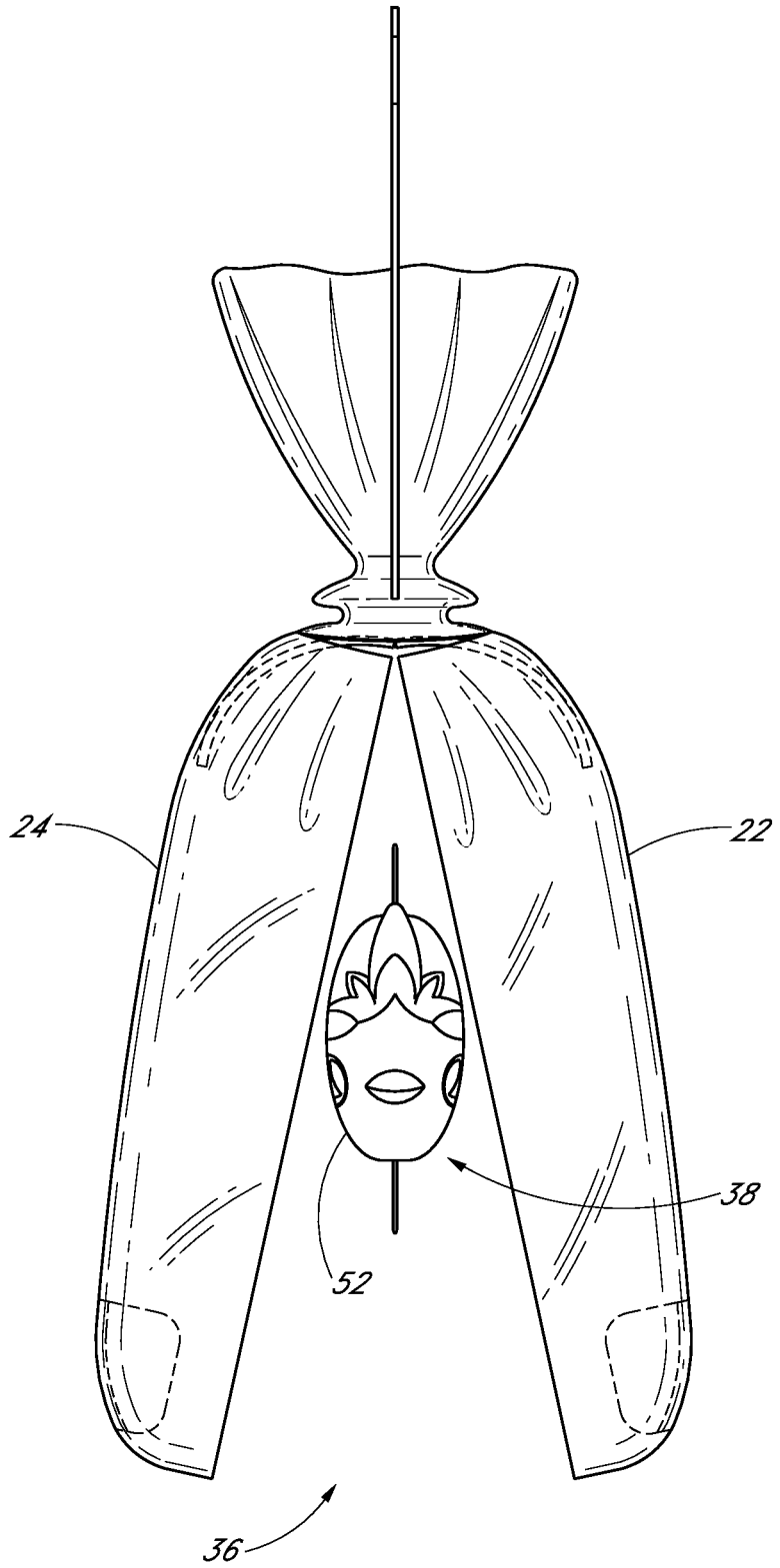
FIG. 16 is a side view of the toy package from FIG. 14 showing an opening for the toy to exit the toy package.

FIG. 16 is a side view of the toy package 20 from FIG. 14 showing the side opening 38 for the toy 52 to exit the toy package 20. In the illustrated embodiment, the side opening 38 is sized and shaped to allow the toy 52 to exit the interior 30 of the toy package 20. In other embodiments, the toy 52 exits the toy package 20 through the bottom opening 36. In embodiments where the predefined action is the swimming action, the toy 52 can swim out of the toy packaging under its own power.

Figure 17:
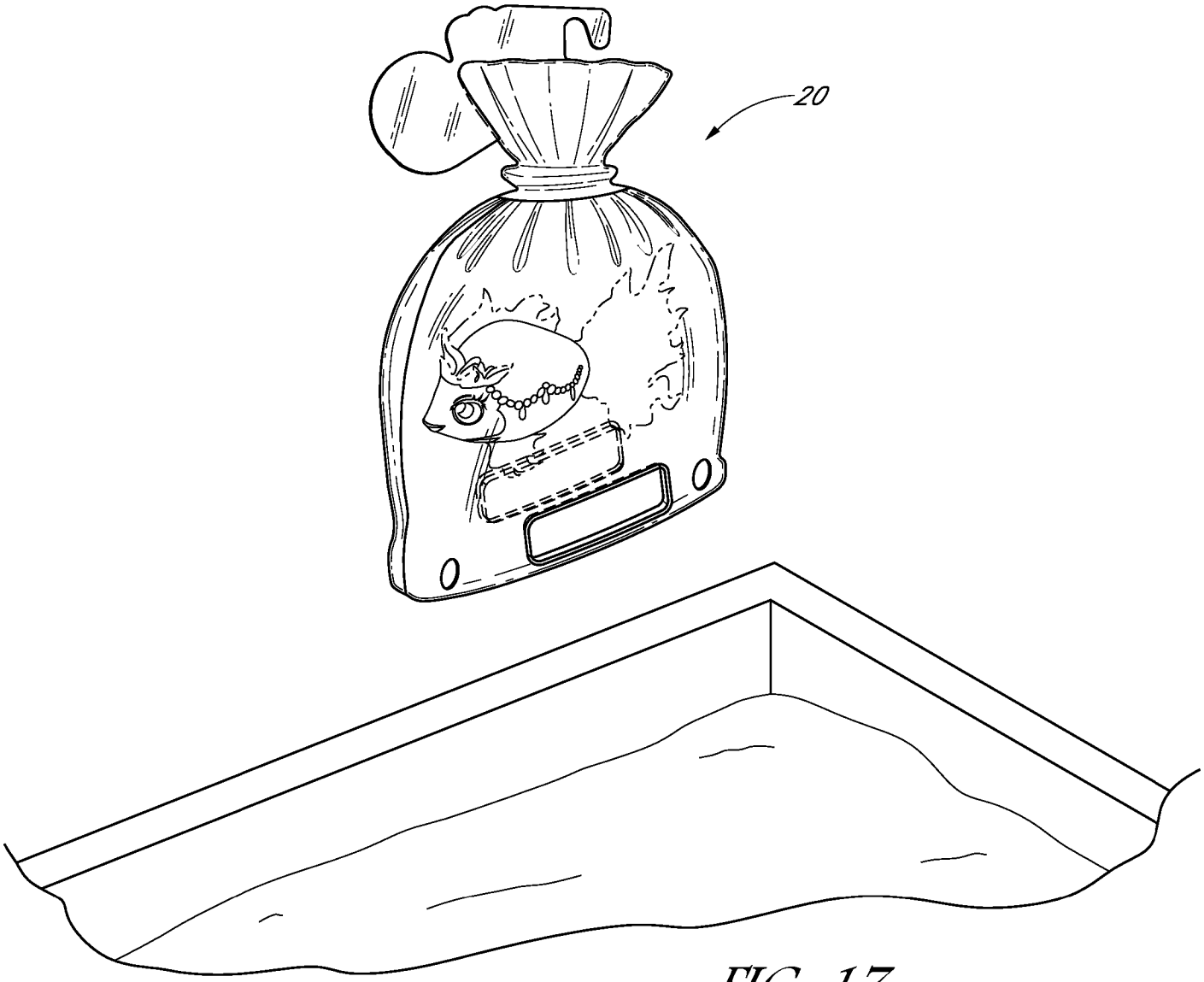
FIG. 17 is a perspective view of the toy packaging prior to being submerged in a liquid.
Figure 18:
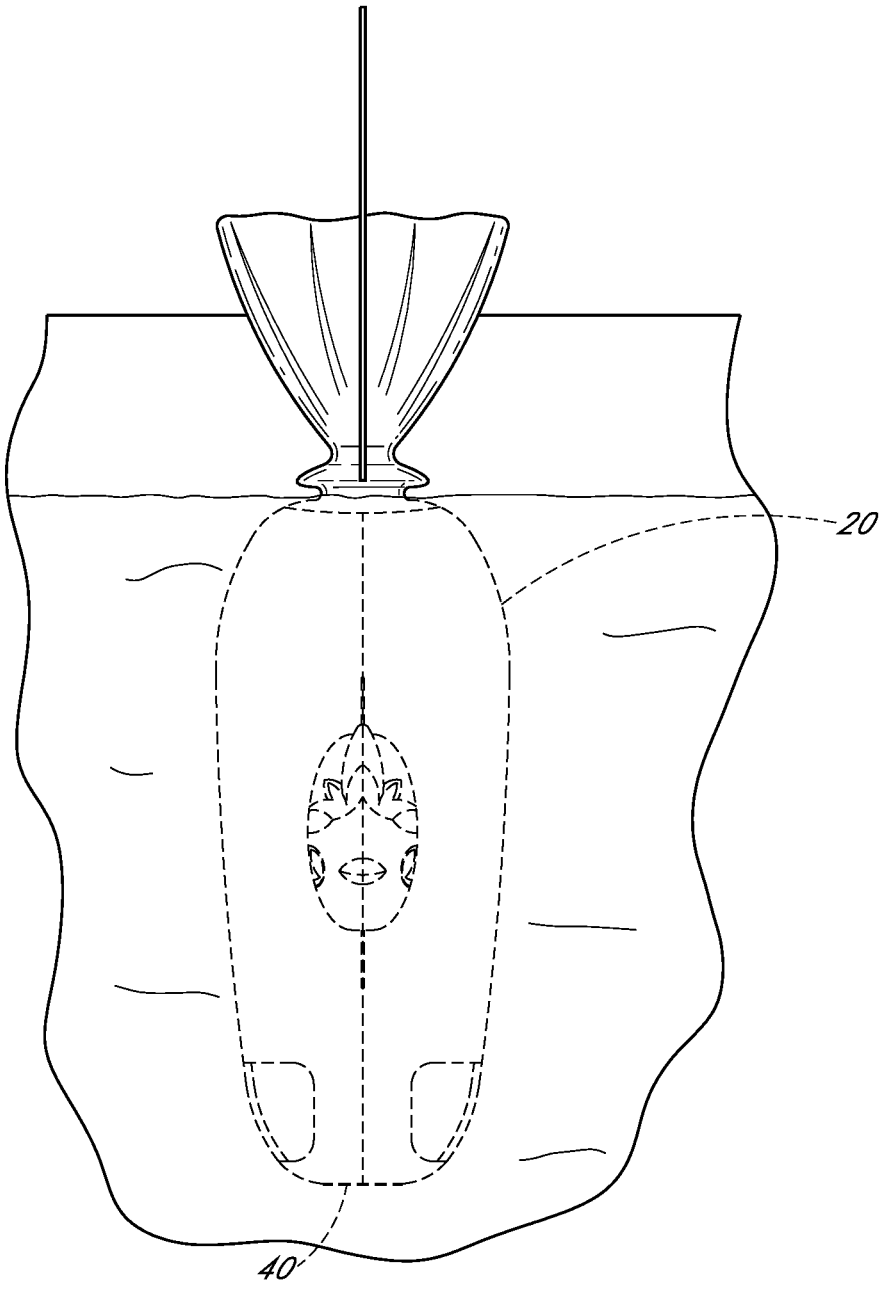
FIG. 18 is a side view of the toy packaging submerged in the liquid and in a closed configuration.

FIG. 17 is a perspective view of the toy package 20 prior to being submerged in the liquid. FIG. 18 is a side view of the toy package 20 submerged in the liquid and in the closed configuration. In certain embodiments, the film 40 comprises a water soluble material. In certain embodiments, the film 40 comprises a dissolvable material. The film 40 is disposed across at least a portion of the seam 34 to prevent the toy package 20 from moving to the open configuration. In certain embodiments, the film 40 is only placed over portions of the seam 34 that are submerged in water during unboxing.

In the illustrated embodiment, the film 40 is disposed over a portion of the seam 34 that extends along the bottom opening 36. The film 40 begins dissolving when submerged as shown in FIG. 18 to allow the buoyancy system 44 to assist the toy package 20 to move from the closed configuration to the open configuration without user intervention. Submerging the toy package 20 begins the unboxing experience. In certain embodiments, the film 40 is a tape. In certain embodiments, the film 40 prevents the toy package 20 from releasing the toy 52 until after the film 40 is dissolved by the same water that causes the toy package 20 to release the toy 52 without customer intervention.

Figure 19:
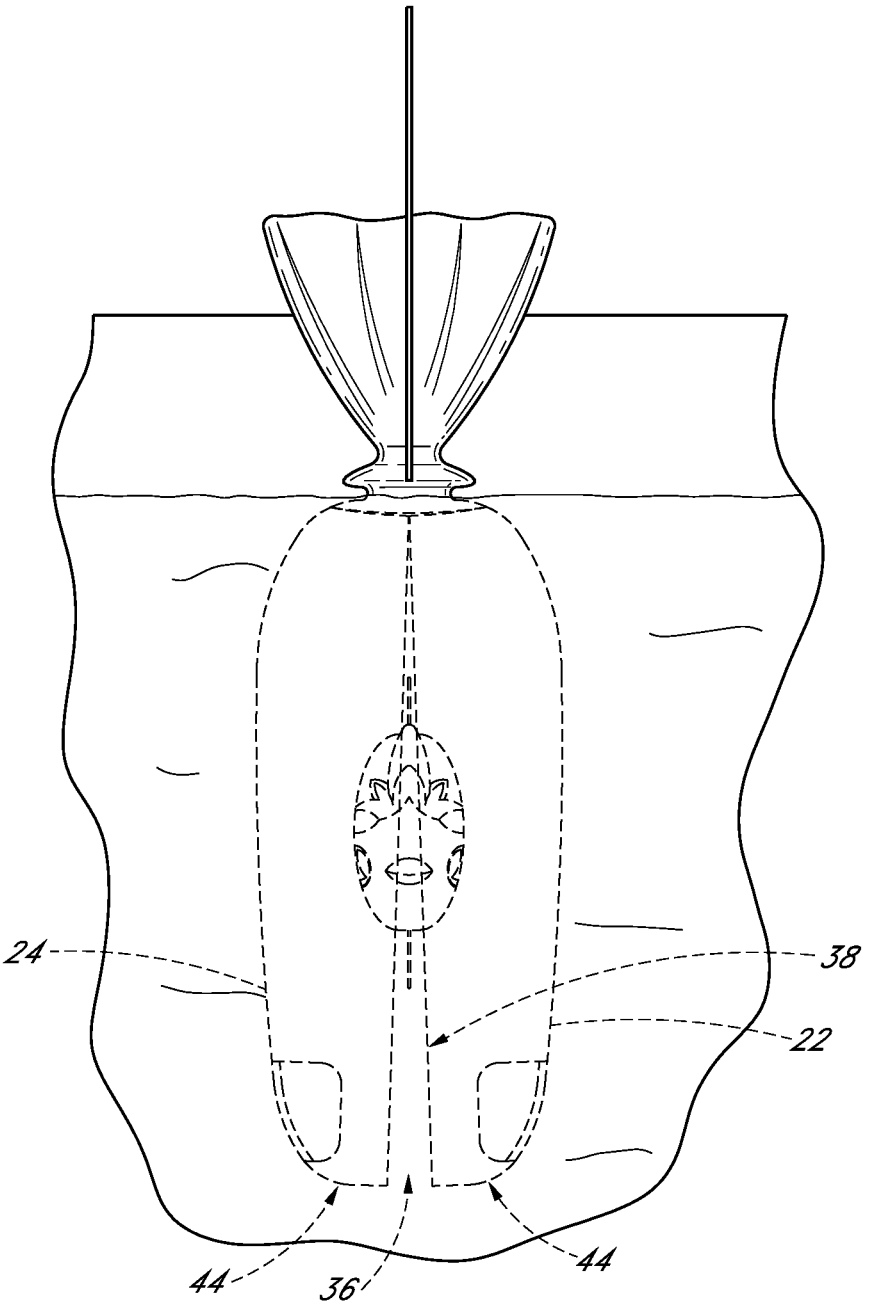
FIG. 19 is a side view similar to FIG. 18 after a film sealing the toy packaging has dissolved allowing the buoyancy system to begin separating a first portion from a second portion of the toy packaging without user intervention.
Figure 20:
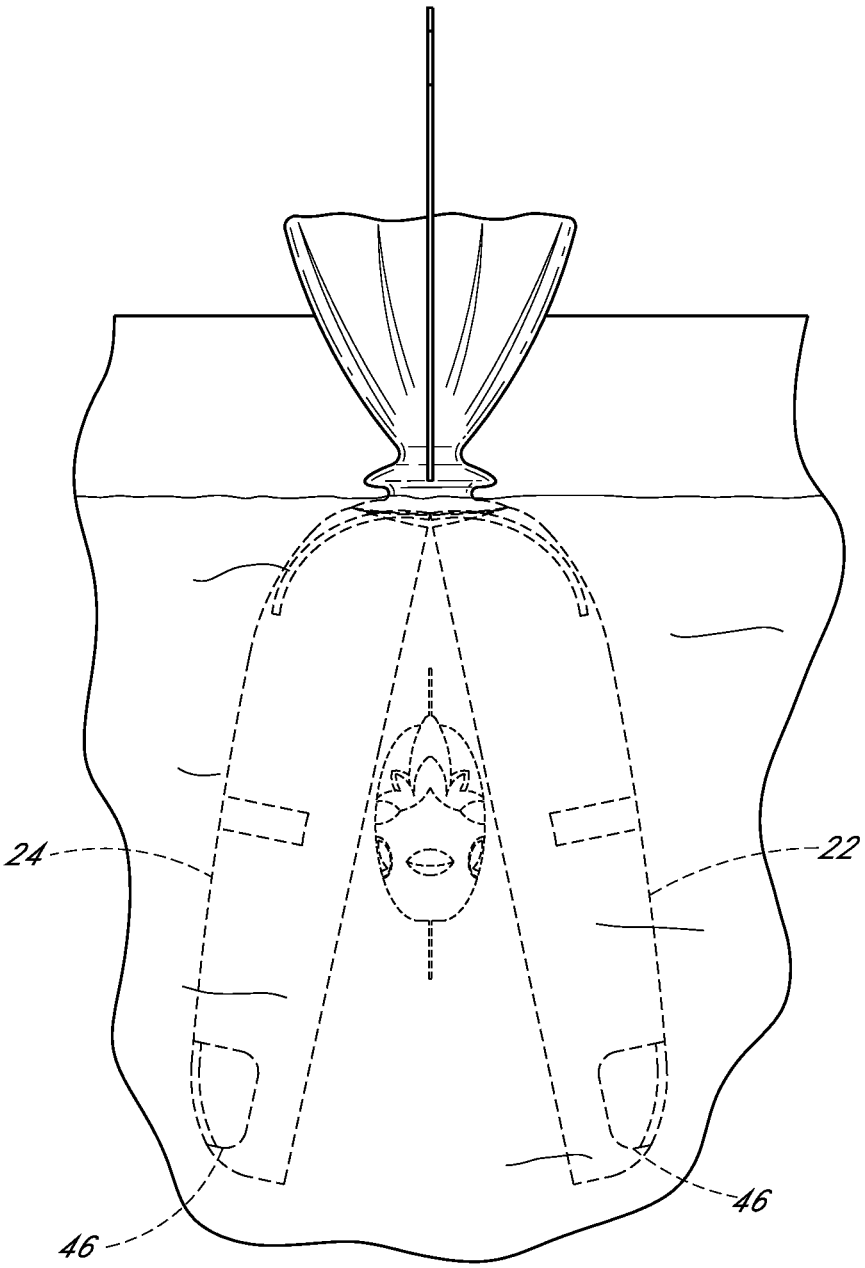
FIG. 20 is a side view similar to FIG. 19 after the buoyancy system has fully separated the first portion from the second portion to form an opening for the toy to exit the toy packaging.

FIG. 19 is a side view similar to FIG. 18 after the film 40 sealing the toy package 20 has dissolved allowing the buoyancy system 44 to begin separating the first portion 22 from the second portion 24 of the toy package 20 without user intervention. The support 50 has partially released the toy 52. FIG. 20 is a side view similar to FIG. 19 after the buoyancy system 44 has fully separated the first portion 22 from the second portion 24 to form the side opening 38 for the toy 52 to exit the toy package 20. In certain embodiments, the water sensor 54 senses when the water contacts the toy 52. After the water sensor 54 senses water, the water sensor 54 sends a signal to the toy 52 to begin the swimming action. In FIG. 20, the support 50 has completely released the toy 52. Once the toy 52 is disengaged from the support 50, the toy 52 is able to move towards the side opening 38 using its swimming action.

Figure 21:
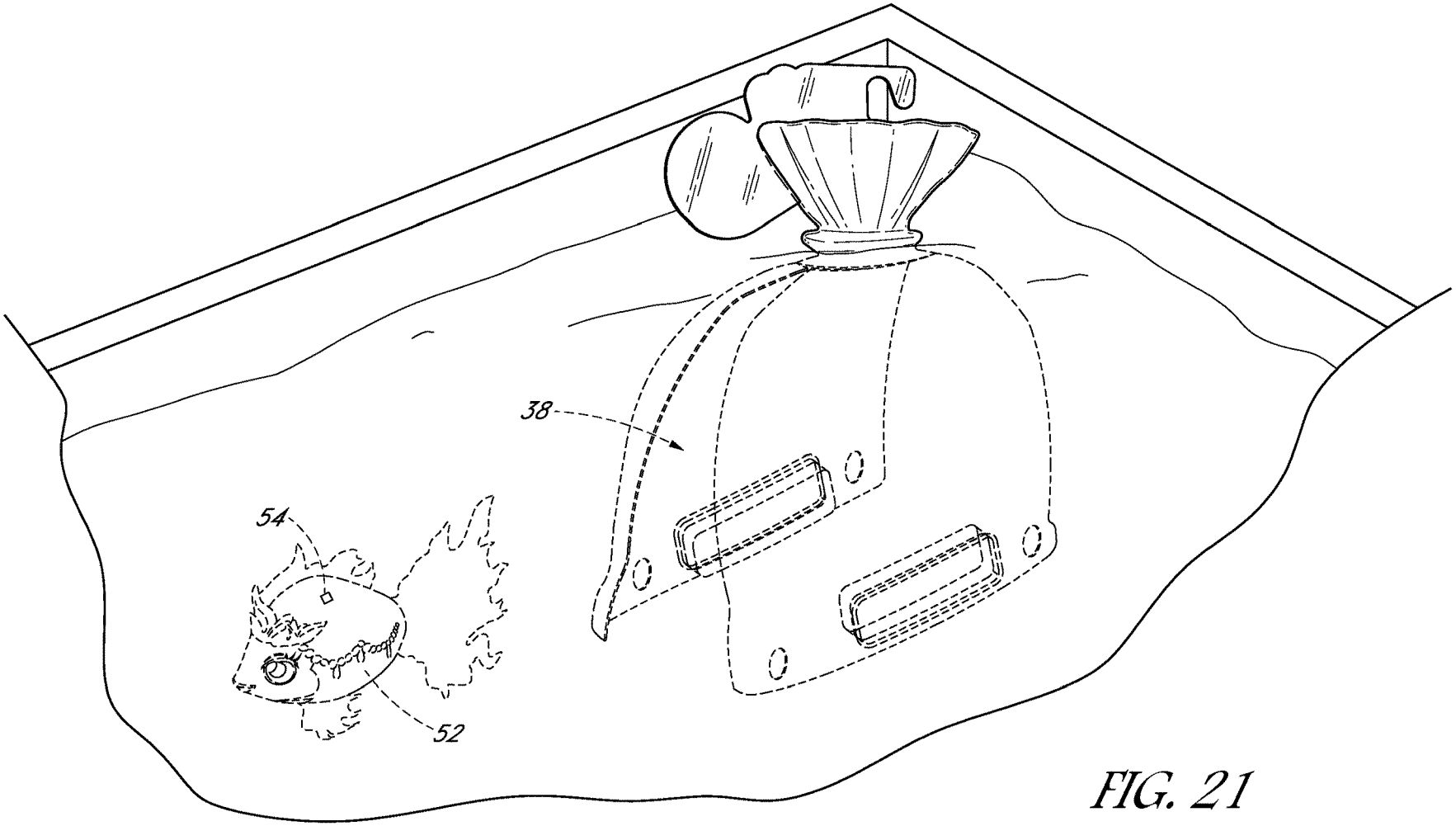
FIG. 21 is a side view similar to FIG. 17 showing the toy exiting the toy packaging through the opening without user intervention.

FIG. 21 is a side view similar to FIG. 17 showing the toy 52 exiting the toy package 20 through the side opening 38 without user intervention.

Figure 22:
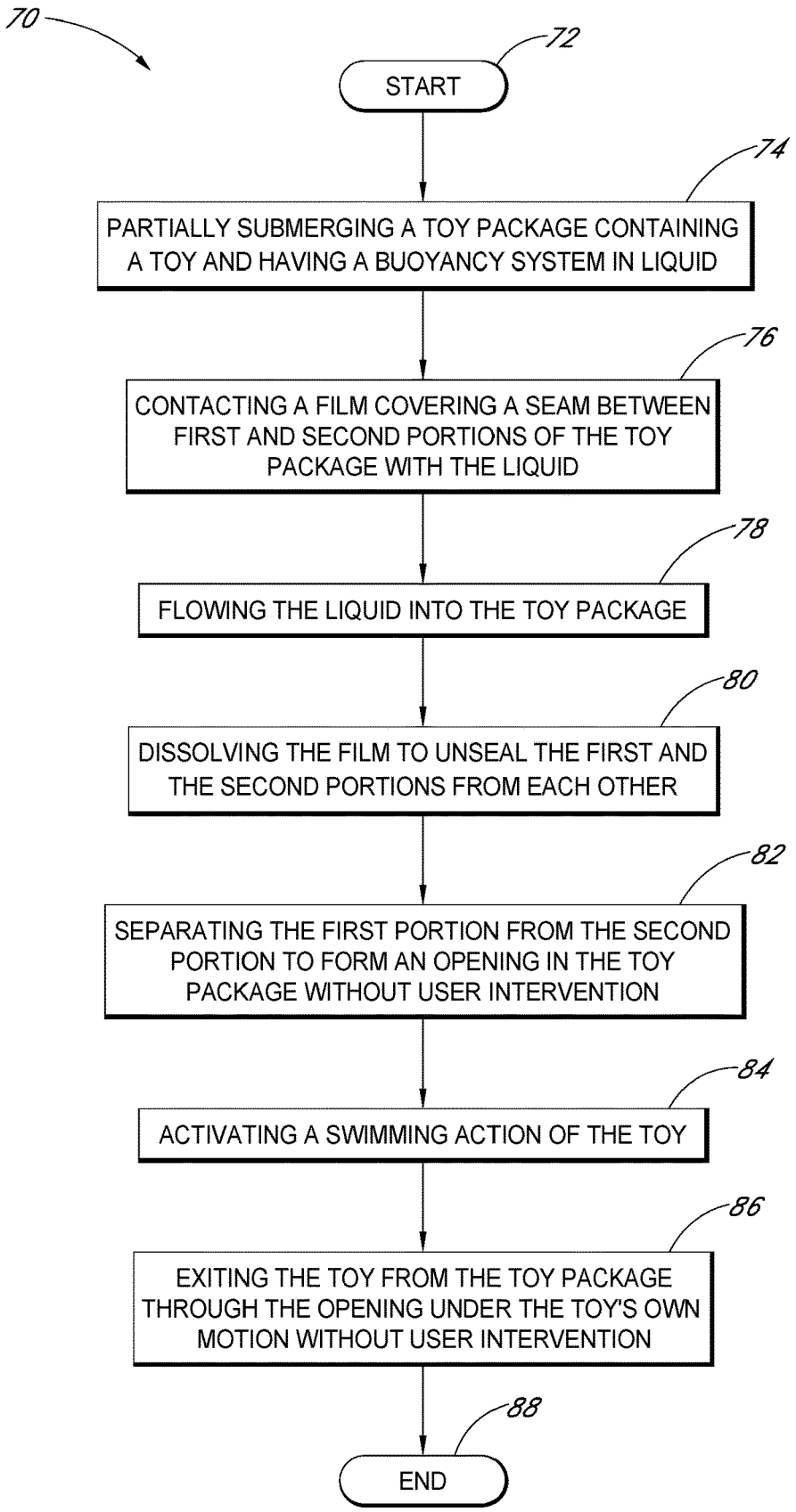
FIG. 22 illustrates a method that can be employed by the toy packaging of FIG. 1.

FIG. 22 illustrates a method 70 that can be employed by the toy packaging of FIG. 1. The method begins at block 72. The method moves to block 74 where the toy package 20 is partially submerged or dipped in liquid. The user can hold the handle 42 and lower the toy package 20 into the water. The handle 42 has an ergonomic shape to allow the user to maintain control of the toy package 20 during the underwater unboxing of the toy 52.

The method moves to block 76 where the water contacts the film 40 covering the seam 34 between the first and second portions 22, 24 of the toy package 20. In certain embodiments, the film 40 prevents the toy package 20 from releasing the toy 52 until after the film 40 is dissolved by the same water that causes the toy package 20 to release the toy 52 without customer intervention. In certain embodiments, the film 40 comprises a water soluble material. In certain embodiments, the film 40 comprises a dissolvable material. Once contacted with water, the film 40 begins dissolving to allow the buoyancy system 44 to cause the toy package 20 to move from the closed configuration to the open configuration.

The method moves to block 78 where the liquid flows into the toy package 20. The one or more holes 58 are sized and shaped to allow the water to enter the interior 30 of the toy package 20. In certain embodiments, the water slowly fills the interior 30 but does not fill the one or more chambers 46 of the buoyancy system 44.

The method then moves to block 80 where the film 40 is dissolved to unseal the first and the second portions 22, 24 from each other. The method then moves to block 82 where the first portion 22 is separated from the second portion 24 to form an opening, such as the side opening 38, in the toy package 20 without user intervention. The buoyance system 44 causes the first and second portions 22, 24 to move to the open configuration without user intervention. In certain embodiments, the buoyance system 44 comprises one or more chambers 46. In certain embodiments, the one or more chambers 46 are filled with a gas. For example, the gas can be air or any other gas. In certain embodiments, the one or more chambers 46 are filled by a material. For example, the material can be foam or any other material that has a density less than the liquid. In certain embodiments, the one or more chambers 46 are sealed around the volume 48. In certain embodiments, the one or more chambers 46 are molded into each half (the first portion 22 and the second portion 24) of the toy package 20.

Next, at block 84, the swimming action of the toy is activated. In certain embodiments, the toy 52 comprises a water sensor 54 that senses when the water contacts the toy 52. For example, the water sensor 54 can be configured as a capacitive sensor. After the water sensor 54 senses water, the water sensor 54 sends a signal to the toy 52 to begin a predefined action. In certain embodiments, the predefined action is a swimming action.

The method then moves to block 86 where the toy 52 exits the toy package 20 through the opening under the toys own motion without user intervention. In the illustrated embodiment, the side opening 38 is sized and shaped to allow the toy 52 to exit the interior 30 of the toy package 20. In other embodiments, the toy 52 exits the toy package 20 through the bottom opening 36. In embodiments where the predefined action is the swimming action, the toy 52 can swim out of the toy packaging under its own power. The method ends at block 88.

For expository purposes, the term "horizontal" as used herein is defined as a plane parallel to the plane or surface of the water in which the system being described is used or the method being described is performed, regardless of its orientation. The term "floor" can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

While the preferred embodiments of the present inventions have been described above, it should be understood that they have been presented by way of example only, and not of limitation. It will be apparent to persons skilled in the relevant art that various changes in form and detail can be made therein without departing from the spirit and scope of the inventions. Thus, the present inventions should not be limited by the above-described exemplary embodiments, but should be defined only in accordance with the following claims and their equivalents. Furthermore, while certain advantages of the inventions have been described herein, it is to be understood that not necessarily all such advantages may be achieved in accordance with any particular embodiment of the inventions. Thus, for example, those skilled in the art will recognize that the inventions may be embodied or carried out in a manner that achieves or optimizes one advantage or group of advantages as taught herein without necessarily achieving other advantages as may be taught or suggested herein.

What is claimed is:

1. Toy packaging configured to be partially submerged in liquid to cause the toy packaging to move from a closed configuration to an open configuration, the toy packaging comprising:

a first portion supported by a second portion, at least one of the first portion and the second portion being movable relative to the other one of the first portion and the second portion from the closed configuration to the open configuration, the first portion and the second portion defining a receptacle when in the closed configuration;

a toy disposed in the receptacle at least when the toy packaging is in the closed configuration and at least partially submerged in the liquid; and a buoyancy system supported by at least one of the first portion and the second portion, the buoyancy system comprising a first gas chamber and a second gas chamber, the first gas chamber and the second gas chamber being configured to apply separate buoyancy forces to the first portion and the second portion, respectively, to assist the toy packaging to move from the closed configuration to the open configuration when the buoyancy system is submerged in the liquid.

2. The toy packaging of claim 1, wherein the first portion and the second portion form a seam when in the closed configuration, and wherein the toy packaging opens at the seam when the toy packaging moves from the closed configuration to the open configuration.

3. The toy packaging of claim 2, further comprising a film disposed across at least a portion of the seam to prevent the toy packaging from moving to the open configuration, the film being configured to dissolve when submerged in liquid to allow the buoyancy system to assist the toy packaging system to move from the closed configuration to the open configuration.

4. The toy packaging of claim 3, wherein the opening of the toy packaging includes a bottom opening portion and a side opening portion, and wherein the at least a portion of the seam is disposed over the bottom opening portion.

5. The toy packaging of claim 2, wherein the opening of the toy packaging includes a bottom opening portion and a side opening portion, the liquid entering the receptacle through the bottom opening and the toy exiting the receptacle through the side opening when the toy packaging is at least partially submerged in the liquid and in the open configuration.

6. The toy packaging of claim 1, further comprising a handle, the handle configured to be disposed above the liquid when the toy packaging is at least partially submerged in the liquid.

7. The toy packaging of claim 1, wherein each of the first and second gas chambers defines a volume of gas, the gas having a lower density that the liquid.

8. The toy packaging of claim 1, wherein at least one of the first portion or the second portion comprises a hole, the hole being sized and shaped to allow the liquid to the enter the receptacle when the hole is at least partially submerged in the liquid.

9. The toy packaging of claim 1, wherein the toy comprises a sensor, and wherein the sensor is configured to activate the toy when the sensor is contacted with the liquid.

10. The toy packaging of claim 1, further comprising a support disposed in the receptacle, the support immobilizing the toy when the toy packaging is in the closed configuration and releasing the toy when the toy packaging is in the open configuration.

11. The toy packaging of claim 1, wherein the first portion and the second portion are supported by a hinge.

12. The toy packaging of claim 1, further comprising a spring, wherein the spring is configured to assist the toy packaging to move from the closed configuration to the open configuration.

13. Toy packaging configured to be partially submerged in liquid to cause the toy packaging to move from a closed configuration to an open configuration, the toy packaging comprising:

a handle;

a first portion rotatably coupled to the handle and movable from the closed configuration to the open configuration, the first portion having a first sealed gas chamber; and a second portion rotatably coupled to the handle and movable from the closed configuration to the open configuration, the second portion having a second sealed gas chamber, wherein the first portion and the second portion define a receptacle when in the closed configuration, and wherein the first sealed gas chamber and the second sealed gas chamber each create a buoyancy force applied to the first portion and the second portion, respectively, which assists the toy packaging to move from the closed configuration to the open configuration when the first sealed gas chamber and the second sealed gas chamber are submerged in the liquid.

14. The toy packaging of claim 13, further comprising a toy disposed in the receptacle at least when the toy packaging is in the closed configuration and at least partially submerged in the liquid.

15. The toy packaging of claim 13, further comprising a film contacting both the first portion and the second portion when the toy packaging is in the closed configuration, the film being configured to dissolve when submerged in liquid.

16. The toy packaging of claim 13, wherein at least one of the first portion or the second portion comprises a hole, the hole being sized and shaped to allow the liquid to the enter the receptacle when the hole is at least partially submerged in the liquid.

17. Toy packaging configured to be partially submerged in liquid to cause the toy packaging to move from a closed configuration to an open configuration, the toy packaging comprising:

a first portion movable from the closed configuration to the open configuration, the first portion having a first gas chamber; and a second portion rotatably coupled to the first portion and movable from the closed configuration to the open configuration, the second portion having a second gas chamber, wherein the first portion and the second portion define a receptacle when in the closed configuration, and wherein the first gas chamber and the second gas chamber each create a buoyancy force applied to the first portion and the second portion, respectively, which assists the toy packaging to move from the closed configuration to the open configuration.

18. The toy packaging of claim 17, further comprising a handle coupled to at least one of the first portion or the second portion.

19. Toy packaging configured to be partially submerged in liquid to cause the toy packaging to move from a closed configuration to an open configuration, the toy packaging comprising:

a handle;

a first portion rotatably coupled to the handle and movable from the closed configuration to the open configuration, the first portion having a first sealed gas chamber;

a second portion rotatably coupled to the handle and movable from the closed configuration to the open configuration, the second portion having a second sealed gas chamber; and a film contacting both the first portion and the second portion when the toy packaging is in the closed configuration, the film being configured to dissolve when submerged in liquid, wherein the first portion and the second portion define a receptacle when in the closed configuration, and wherein the first sealed gas chamber and the second sealed gas chamber create a buoyancy force which assists the toy packaging to move from the closed configuration to the open configuration when the first sealed gas chamber and the second sealed gas chamber are submerged in the liquid.

* * * * *